US006019341A

United States Patent [19]

Brown et al.

[11] Patent Number: 6,019,341

[45] Date of Patent: Feb. 1, 2000

[54] CHRISTMAS TREE STAND

[75] Inventors: Patrick W. Brown, Strongsville; Robert L. Dorsey, Columbia Station, both of Ohio; Cleve A. Graham, Simi Valley; Spencer L. Mackay, Agoura Hills, both of Calif.; John J. Pastrick, University Heights, Ohio; Jeffrey S. Plantz, Sevin Hills, Ohio; Gary R. Stephan, Cleveland, Ohio

[73] Assignee: County Line Limited, L.L.C., Warrensville Hts., Ohio

[21] Appl. No.: 08/644,450

[22] Filed: May 13, 1996

[51] Int. Cl.[7] ..... A47G 7/02

[52] U.S. Cl. ..... 248/516; 407/40.5; 248/525

[58] Field of Search ..... 248/511, 514, 248/515, 516; 47/40.5

[56] References Cited

U.S. PATENT DOCUMENTS

| | | |
|---|---|---|
| D. 258,780 | 4/1981 | Wasserman . |
| D. 329,622 | 9/1992 | Smith . |
| D. 332,582 | 1/1993 | Quinn . |
| D. 339,549 | 9/1993 | Hermanson . |
| D. 342,694 | 12/1993 | Frost . |
| D. 344,250 | 2/1994 | Johnson et al. . |
| D. 344,911 | 3/1994 | Stork . |
| D. 345,943 | 4/1994 | Lujan, Jr. . |
| D. 347,599 | 6/1994 | Johnson et al. . |
| D. 349,259 | 8/1994 | Adam . |
| D. 350,915 | 9/1994 | Stork . |
| D. 351,570 | 10/1994 | Fillipp . |
| D. 353,788 | 12/1994 | Frost et al. . |
| D. 354,021 | 1/1995 | Kielbasa . |
| 868,568 | 10/1907 | Jones . |
| 1,224,607 | 5/1917 | Craven . |
| 1,253,572 | 1/1918 | Buchanan . |
| 1,551,093 | 8/1925 | Fletcher . |
| 1,615,621 | 1/1927 | Goodnow . |
| 1,855,762 | 4/1932 | Kaminski . |
| 1,997,870 | 4/1935 | Merrill . |
| 2,044,192 | 8/1936 | Templin, Jr. . |
| 2,337,914 | 12/1943 | Meldrum . |
| 2,493,633 | 1/1950 | Mart . |
| 2,587,788 | 3/1952 | Tacy . |
| 2,605,067 | 11/1952 | Lindsell . |
| 2,609,169 | 9/1952 | Kroeger . |
| 2,733,032 | 1/1956 | Farley et al. . |
| 2,812,916 | 11/1957 | Jonasson et al. . |
| 2,905,414 | 9/1959 | Zierden . |
| 2,915,620 | 12/1959 | Robinson . |
| 2,933,274 | 4/1960 | Mausolf . |
| 2,980,377 | 4/1961 | Nielsen et al. . |
| 2,994,498 | 8/1961 | Sager . |
| 2,997,264 | 8/1961 | Zelenitz . |
| 3,204,898 | 9/1965 | Manning . |
| 3,298,642 | 1/1967 | Taylor . |
| 3,298,643 | 1/1967 | Taylor . |

(List continued on next page.)

FOREIGN PATENT DOCUMENTS

| | | |
|---|---|---|
| 0 711 521 A1 | 5/1996 | European Pat. Off. . |
| 153889 | 8/1988 | Japan . |
| 2 115 479 | 2/1983 | United Kingdom . |

OTHER PUBLICATIONS

"Perennial Problem: How to Get a Conifer to Stand Straight," Barbara Marsh.

Sale of Christmas Tree Stand Model XTS1—Sale 1994.

*Primary Examiner*—Derek J. Berger

*Attorney, Agent, or Firm*—Calfee, Halter & Griswold, LLP

[57] ABSTRACT

A tree stand for receiving and supporting a tree, such as a live, cut Christmas tree, comprises a receptacle for receiving the trunk of the tree and a base for supporting the receptacle when the tree is received therein. The receptacle includes a clamping assembly for securing the trunk of the tree in the receptacle, while the base includes a locking assembly for locking the tree in place once it is moved to the desired vertical position. An actuator such as a foot pedal is provided for operating the locking assembly so that the user can position the tree by hand while standing on his feet with the foot pedal depressed and then lock the tree in place simply by releasing the pedal.

11 Claims, 21 Drawing Sheets

U.S. PATENT DOCUMENTS 3,661,349 5/1972 DeVries ..... 47/40.5
3,715,095 2/1973 Drablowski .
3,779,493 12/1973 Gidlof .
3,783,547 1/1974 Bystrom et al. .
3,901,469 8/1975 Davis et al. .
4,126,963 11/1978 Dunbar .
4,130,965 12/1978 Patton et al. .
4,156,323 5/1979 Scheffler .
4,159,096 6/1979 Chase .
4,231,539 11/1980 Sandham .
4,254,578 3/1981 Hanfeld .
4,260,365 4/1981 Kayne .
4,261,138 4/1981 St. George Syms .
4,261,402 4/1981 Stanaitis .
4,286,409 9/1981 Taylor et al. .
4,354,654 10/1982 Werner et al. ..... 248/663
4,381,621 5/1983 Eby .
4,393,621 7/1983 Rodell .
4,397,895 8/1983 Poe .
4,408,415 10/1983 Davis et al. .
4,429,846 2/1984 Halvorson .
4,436,272 3/1984 Lile et al. .
4,541,601 9/1985 Corbisello .
4,562,988 1/1986 Bumgardner ..... 248/349
4,565,028 1/1986 Stephan .
4,571,882 2/1986 Capen .
4,596,262 6/1986 Tegze .
4,611,781 9/1986 Wiegand .
4,699,347 10/1987 Kuhnley .
4,726,553 2/1988 Wischusen, III .
4,884,363 12/1989 Sofy .
4,901,971 2/1990 Connelly .
4,913,395 4/1990 Juhas ..... 47/40.5 X
4,936,538 6/1990 Royce .
4,967,508 11/1990 Reynolds .
4,976,411 12/1990 Gordon et al. .
5,000,414 3/1991 Rosato .
5,014,461 5/1991 vom Braucke et al. .
5,048,230 9/1991 Bernardy .
5,074,514 12/1991 Smith .
5,086,583 2/1992 Breen .
5,114,113 5/1992 Krinner .
5,121,897 6/1992 Sofy .
5,137,246 8/1992 Idso .
5,201,140 4/1993 Voorhis .
5,209,450 5/1993 Grapes .
5,236,167 8/1993 Tai et al. .
5,243,782 9/1993 Jones .
5,249,772 10/1993 Montie, Jr. et al. .
5,279,071 1/1994 McDougall .
5,280,871 1/1994 Chuang ..... 248/516
5,290,004 3/1994 Frost et al. .
5,299,381 4/1994 Oldenburg, Jr. .
5,301,462 4/1994 Hronyetz ..... 47/40.5
5,318,267 6/1994 Rast .
5,320,323 6/1994 Clark, Jr. .
5,323,558 6/1994 Baumler .
5,327,677 7/1994 Rivera .
5,330,368 7/1994 Tsuruzono .
5,333,828 8/1994 Severeid .
5,335,730 8/1994 Cotham, III .
5,337,990 8/1994 Brown .
5,338,585 8/1994 Fraus et al. .
5,342,661 8/1994 Wilcox, II .
5,349,997 9/1994 Rial .
5,350,149 9/1994 Evans, Jr. et al. .
5,359,502 10/1994 Cantin .
5,362,024 11/1994 Grinnen .
5,363,591 11/1994 Jones .
5,369,910 12/1994 Copenhaver .
5,373,997 12/1994 Baltensperger et al. .
5,375,807 12/1994 Claas .
5,375,808 12/1994 Roy .
5,388,799 2/1995 Keefe .
5,393,031 2/1995 Leve .
5,398,444 3/1995 Murray .
5,407,168 4/1995 Shultz .
5,410,838 5/1995 O'Leary et al. .
5,454,188 10/1995 Sofy .
5,467,959 11/1995 Behringer .
5,484,131 1/1996 Aldrete et al. ..... 47/40.5 X
5,507,195 4/1996 Kalman et al. ..... 47/40.5

CHRISTMAS TREE STAND

BACKGROUND OF THE INVENTION

The present invention relates to an improved Christmas tree stand.

Many designs have been proposed for Christmas tree stands suitable for supporting and positioning a live, cut Christmas tree.

For example, Capen, U.S. Pat. No. 4,571,882; Scheffler, U.S. Pat. No. 4,156,323; Gidlof, U.S. Pat. No. 3,779,493; and Davis, U.S. Pat. No. 4,408,415, describe Christmas tree stands in which a ball and socket arrangement is used to position the tree in the desired position. Hronyetz, U.S. Pat. No. 5,301,462, and Murray, U.S. Pat. No. 5,398,444, show related designs in which the trunk of the tree is received inside the ball and socket. In each of these designs, the socket is compressible so that the ball and hence the tree attached thereto can be locked into place once the tree is moved to the desired position.

Corbsello, U.S. Pat. No. 4,541,601, shows a related design in which the trunk of the tree is also received inside the ball and socket. However, in Corbsello, threaded fasteners are provided in a side wall of the tree stand for securing the tree in a desired vertical position.

Montie, U.S. Pat. No. 5,249,772; Mousolf, U.S. Pat. No. 2,933,274; Krinner, U.S. Pat. No. 5,114,113 and Jones, U.S. Pat. No. 5,363,591 show related designs in which a tree pivotally mounted on its bottom to a base is locked in position by ropes or arms attached to the trunk of the tree.

Drablowski, U.S. Pat. No. 3,715,095, shows a stand in which a receptacle for receiving the trunk of the tree is mounted on a tripod arrangement which allows the receptacle to be moved to different positions for vertically positioning the tree. A retaining pin is provided to lock the receptacle in place in the tripod once the tree is moved to the desired position.

Adams, Des. 349,259; Oldenburg, U.S. Pat. No. 5,299,381, and Grinner, U.S. Pat. No. 5,362,024, show tree stands in which adjustable floor pads are used to properly position the tree.

Kuhnley, U.S. Pat. No. 4,699,347, and Claus, U.S. Pat. No. 5,375,807, show tree stands in which a frame for attaching to the tree is mounted on a base for pivotal movement about perpendicular, horizontal (X and Y) axes.

Patton, U.S. Pat. No. 4,130,965; and Brown, U.S. Pat. No. 5,337,990, show Christmas tree stands in which the weight of the tree in the stand bases a plurality of clamping legs into engagement with the trunk of the tree for supporting the tree in position.

Finally, Roy, U.S. Pat. No. 5,375,808, shows a Christmas tree stand in which a clamping jaw for holding the tree in proper position is actuated by means of a foot pedal attached to the Christmas tree stand base.

Although each of these designs is workable theoretically, in practice none have found any significant commercial use. Those designs which involve ball and socket arrangements with compressible sockets are inherently limited in terms of the size of tree they can accommodate. This is because the compressive forces on the ball necessary to stop the ball from rotating can be immense when center of gravity of the tree is even slightly off center. On the other hand, those designs using ropes or arms attached to the tree trunk have difficulty accommodating non-uniform trunks, off-center trunks, low branches and so forth.

Tripod arrangements are also severely restricted in terms of tree size because of the bending stresses placed on the pivotal joints of the tripod legs. These stresses can become particularly significant when the center of gravity of the tree is positioned not directly over one of the legs but rather between adjacent legs. Tripod arrangements can also be unstable until the full weight of the tree is received therein. Known designs using adjustable floor pads are typically restricted to small tree sizes, because the degree of adjustment of the individual pads is usually comparatively small. Also such designs are often cumbersome and difficult to use, because each floor pad must be individually adjusted.

Accordingly, there is a need for new Christmas tree stand designs which are simple in construction, stable, easy to use, and can accommodate larger trees therein.

SUMMARY OF THE INVENTION

In accordance with the present invention, a tree stand for receiving and supporting a tree, such as a live, cut Christmas tree, comprises a receptacle for receiving the trunk of the tree and a base for supporting the receptacle when the tree is received therein. The receptacle includes a clamping assembly for securing the trunk of the tree in the receptacle, while the base includes a locking assembly for locking the tree in place once it is moved to the desired vertical position.

In one embodiment, the receptacle is movable to a variety of different positions in the base for vertically positioning the tree and the locking assembly operates to lock the receptacle in place with respect to the base after the receptacle is moved to its desired position.

In another embodiment, the base includes movable members such as legs, wedges and the like to vary the position of the base on the floor or other surface on which the stand sits. In these embodiments, the locking assembly locks the movable members in place after the tree is moved to the desired position.

Preferably, an actuator such as a foot pedal is provided for operating the locking assembly so that the user can position the tree by hand while standing on his feet with the foot pedal depressed and then lock the tree in place simply by releasing the pedal.

With this structure, the Christmas tree, once mounted in the inventive tree stand, can be easily moved to a fully upright position with its center of gravity centered over the base, even if the tree trunk is crooked or not centered in the receptacle. Then, the tree can be locked in place in its desired vertical position simply by releasing the foot pedal or other actuator.

It will therefore be appreciated that a live, cut Christmas tree can be easily mounted, centered and locked into a desired vertical position in the inventive Christmas tree stand without shimming or otherwise securing the tree in place as typically done with conventional Christmas tree stands. Moreover, the inventive Christmas tree stand is so designed that concentration of large forces or stresses in small areas is avoided. This results in the inventive Christmas tree stand being made simple in construction, stable, easy to use, and capable of accommodating trees of very large size.

BRIEF DESCRIPTION OF THE DRAWINGS

The present invention may be more readily understood by reference to the following drawings wherein.

DETAILED DESCRIPTION

Figure 1A:
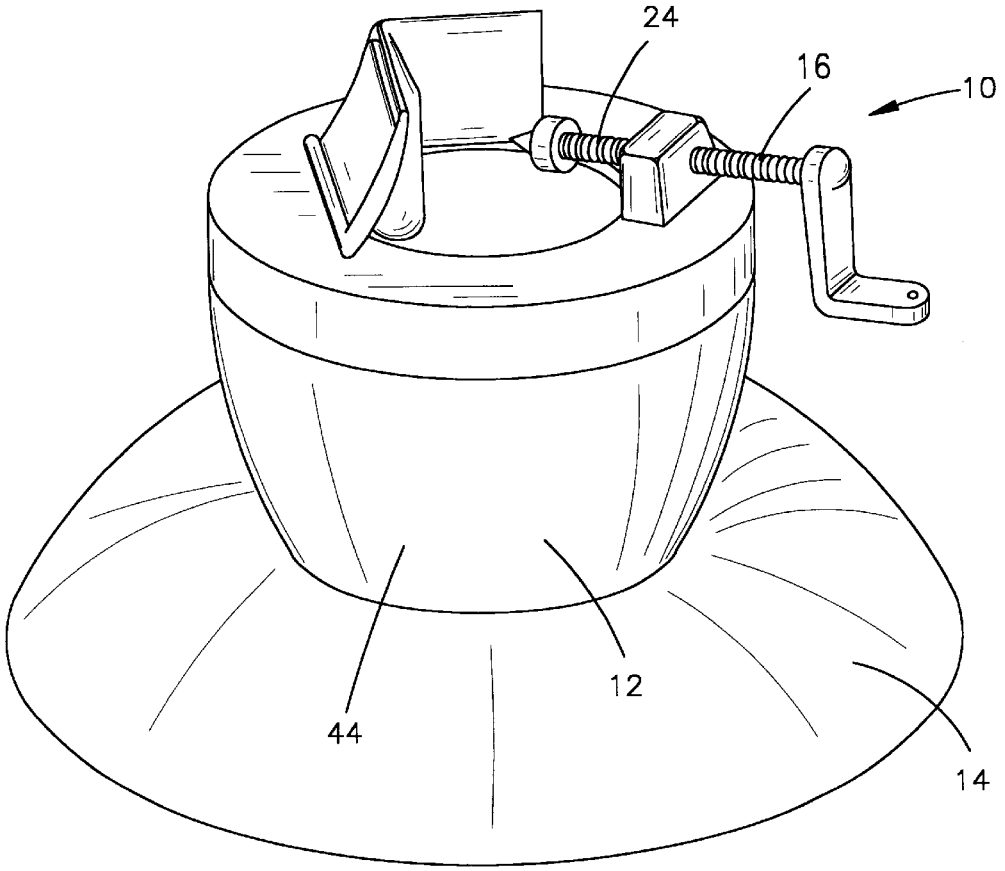
FIGS. 1A and 1B are schematic illustrations of one embodiment of the inventive Christmas tree stand.

In the following description, like number in all of the figures refer to like elements.

Referring to FIGS. 1A, 1B, 7, 10A, 10B, 11A and 11B, the inventive Christmas tree stand generally indicated at 10 takes the form of a receptacle 12 and a base 14. Receptacle 12 is provided with clamping means 16 for securing the trunk 18 of a tree 20 therein. In the embodiment shown in FIGS. 1A and 1B, the clamping means comprises V-shaped member 22 and threaded fastening member 24. A hand crank 26 is provided for turning threaded fastening member 24 so that pointed tip 28 can engage and securely mount trunk 18 of the tree in place against V-shaped member 22.

In the embodiments illustrated in FIGS. 7, 10A, 10B, 11A and 11B, the clamping means comprises a plurality of clamping arms 30 pivotally mounted in central sections thereof about upper portions 32 of receptacles 12. Each of clamping arms 30 is provided on an upper end thereof with a tree-engaging pointed member 34 for engaging and securing trunk 18 of tree 20 above the top of receptacle 12. Each of clamping arms 30 is provided at its lower end with a hand-actuated screw 36 abutting the upper portion 32 of receptacle 12 on its distal end and having a flange 38 on its opposite end for facilitating turning of the screw. With this structure, turning of screws 36 in a clockwise direction, in the embodiments shown, forces the lower ends of clamping arms 30 away from receptacles 12. This, in turn, causes the upper ends of clamping arms 30 to be based inwardly, thereby causing tree-engaging pointed members 34 to engage and securely hold trunk 18 of tree 20 in receptacle 12.

In the embodiments illustrated in FIGS. 7, 10A, 10B, 11A and 11B, the receptacle is further provided at its bottom with a stabilizing member 40, which in the embodiments shown also takes the form of a pointed projection. Stabilizing member acts to secure the bottom of trunk 18 of the tree in place and thereby prevent it from moving laterally in the receptacle.

In each embodiment illustrated in FIGS. 1A, 1B, 7, 10A, 10B, 11A and 11B, receptacle 12 is releasably mounted in base 14. In other words, receptacle 12 can be secured to trunk 18 of the tree separate and apart from base 14, and then receptacle 12 with tree 20 mounted therein can thereafter be placed onto base 14.

In each embodiment shown, base 14 includes a receptacle-mating surface 42 which is adapted to face a base-mating surface 44 defined in a lower portion 46 of receptacle 12. In the embodiments illustrated in FIGS. 1A, 1B and 7, receptacle-mating surface 42 and base-mating surface 44 are both defined by sections of spheres whereby the base-mating surface and receptacle-mating surface matingly engage one another when the receptacle is received in the base.

In each embodiment, a locking assembly generally indicated at 82 is provided for locking receptacle 12 in place with respect to base 14 in a desired position for vertically positioning tree 20. Locking assembly 82 takes the form of one or more projections 48 defined in receptacle-mating surface 42 of the base. Projections 48 are adapted to be received in indentations 50 defined in base-mating surface 44 of receptacle 12. With this structure, receptacle 12 is securely held in place in base 14 in many different positions by locking assembly 82 through the action of gravity alone, fasteners being unnecessary. This allows the user to move tree 20 to a desired vertical position by hand, before resting the full weight of tree 20 and receptacle 12 on base 12. Even though receptacle 12 may not be vertically aligned with base 14 because of crookedness in trunk 18 or off-center positioning trunk 18 in receptacle 12, base 14 will nonetheless receive receptacle 12 and securely hold it and tree 20 in place in the desired position by virtue of projections 48 being received in indentations 50.

In another embodiment of the invention, locking assembly 82, rather than taking the form of a mating set of projections and indentations, can be composed of U-shaped members and adjacent pairs of fins positioned to receive such U-shaped members. This is illustrated in commonly assigned U.S. Pat. No. 5,507,117, the disclosure of which is incorporated herein by reference.

In the embodiments of FIGS. 10A, 10B, 11A and 11B, a universal joint generally indicated at 52 is provided for carrying a significant portion of the weight of receptacle 12 and tree 20. Universal joint 52 takes the form of a collar 54 defining a set of pins 56 for riding on shoulders 58 defined in base 14 and a set of indentations 60, at generally the same horizontal level as pins 56 with respect to the vertical axis of the receptacle, for receiving pins 61 carried on the side surfaces of receptacle 12. With this structure, receptacle 12 can pivotally move about collar 54 in a first vertical plane while collar 54 can pivotally move in a second vertical plane perpendicular to the first vertical plane. Accordingly, when receptacle 12 with tree 20 clamped therein is received in base 12, a significant portion of the weight thereof will be carried by universal joint 52, regardless of the relative position of receptacle 12 with respect to base 14.

Figure 11A:
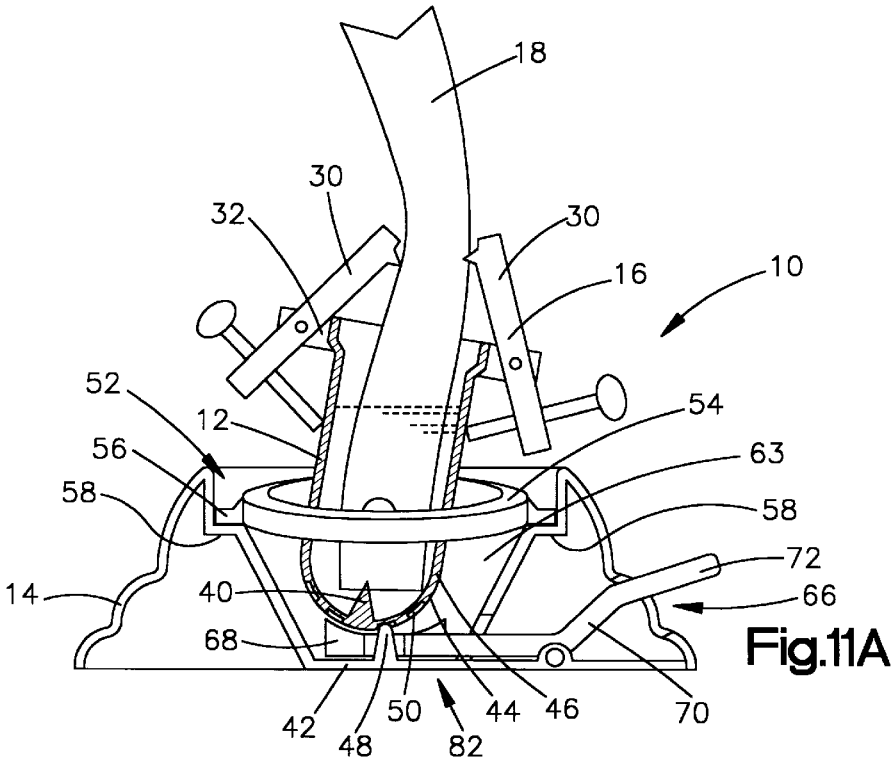
FIGS. 11A and 11B are schematic illustrations of an eleventh embodiment of the inventive Christmas tree stand.
Figure 11B:
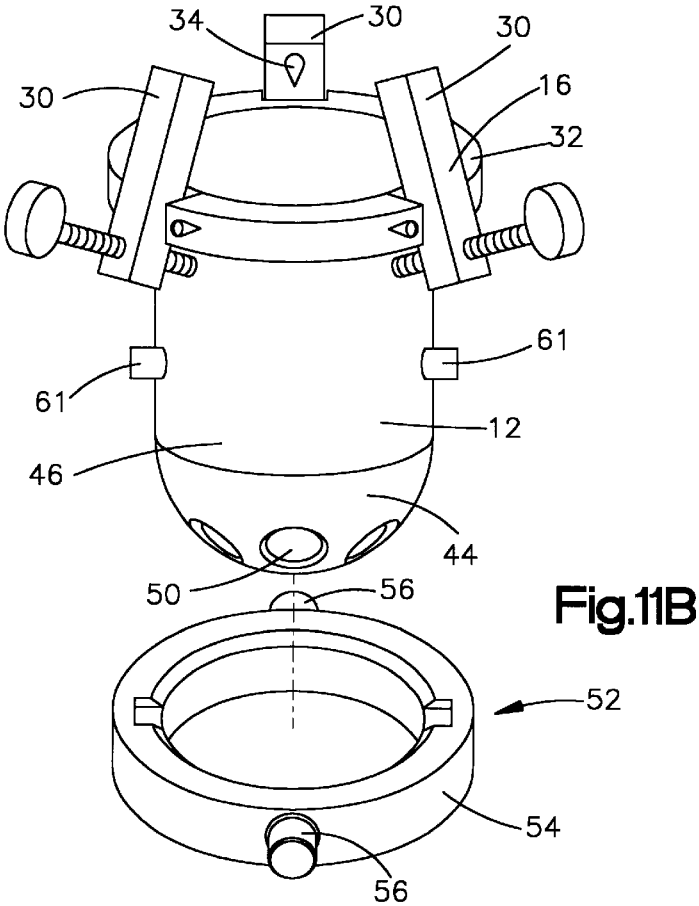

In another version of embodiment illustrated in FIGS. 11A and 11B, lifting pad 68 is adapted to lift receptacle 12 by engaging pins 56 in collar 44. This allows the weight of the receptacle and the tree received therein to be supported by lifting pad 68, actuator arm 70 and foot pedal 72 while the user is moving tree 20 to the desired vertical position.

Figure 1B:
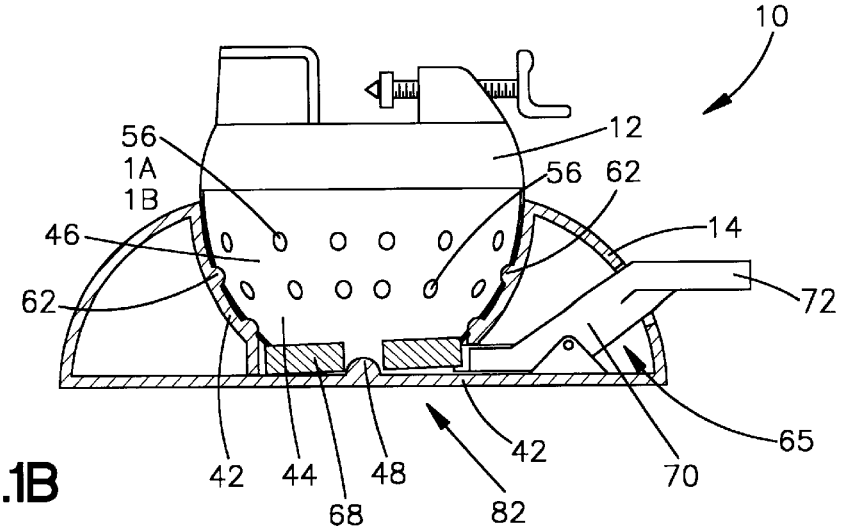

In the embodiments illustrated in FIGS. 1A and 1B, receptacle 12 is liquid-tight. This means that indentations 50 do not pass all the way through base-mating surface 44 of the receptacle, but are simply deep enough to allow secure engagement with projection 48. Also, in this embodiment, supplemental projections 62 are provided in receptacle mating surface 42 of base 14 to further secure receptacle 12 in place. In the embodiments illustrated in FIGS. 10A, 10B, 11A and 11B, indentations 50 take the form of holes passing all the way through base-mating surface 44 of the receptacle. In these embodiments, base 14 is itself provided with a liquid tight chamber 63 for holding water or other liquid for feeding tree 20.

In the embodiments illustrated in FIGS. 1A, 1B, 11A and 11B, an actuator generally indicated at 66 is provided to aid positioning of tree 20 and receptacle 12 in base 14. In these embodiments, actuator 66 comprises a lifting pad 68 attached to a pivotally mounted actuating arm 70 whose distal end carries a foot pedal 72. Depressing foot pedal 72 causes lifting pads 68 to lift receptacle 12 off of projection 48, thereby allowing receptacle 12 to be moved to any desired position for vertically positioning tree 20. Foot pedal 72 can then be released, which in turn causes receptacle 12 with tree 20 therein to be lowered back down on base 14 with projection 48 engaging one of indentations 50 therein for securely mounting the receptacle and tree in the base.

FIGS. 8A, 8B, 9A, 9B, 16A and 16B illustrate additional embodiments of the inventive Christmas tree stand. These embodiments are similar to those illustrated in FIGS. 10A, 10B, 11A and 11B in that these embodiments also employ a universal joint comprising a collar 54 to support a substantial portion of the weight of receptacle 12 and tree 20.

In the embodiment of FIGS. 8A, 8B, 9A and 9B, threaded fasteners 74 received in base 14 and threaded fasteners 76 received in collar 54 replace the indentations/pins/shoulders arrangement shown in FIGS. 10 and 11 for joining collar 54 to receptacle 12 and base 14. With this structure, after receptacle 12 is moved to a desired position for vertically positioning tree 20, threaded fasteners 74 and 76 are then tightened by hand, thereby securing the receptacle and tree in proper position.

Figure 8B:
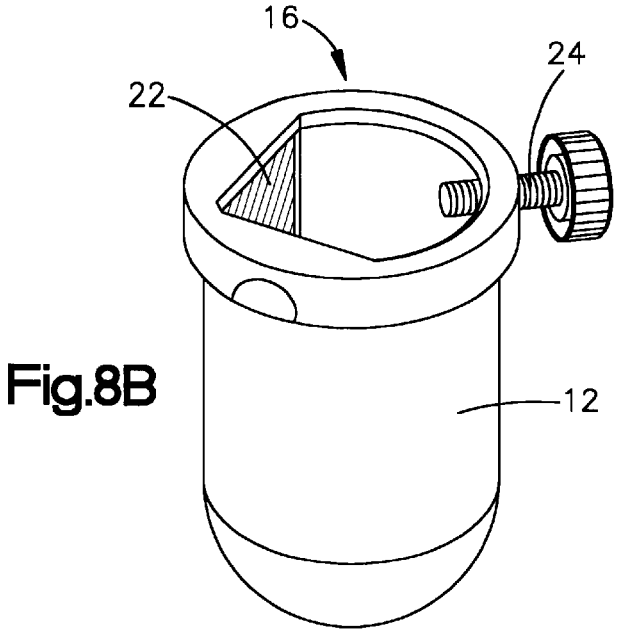
FIGS. 8A and 8B are schematic illustrations of an eighth embodiment of the inventive Christmas tree stand.
Figure 8A:
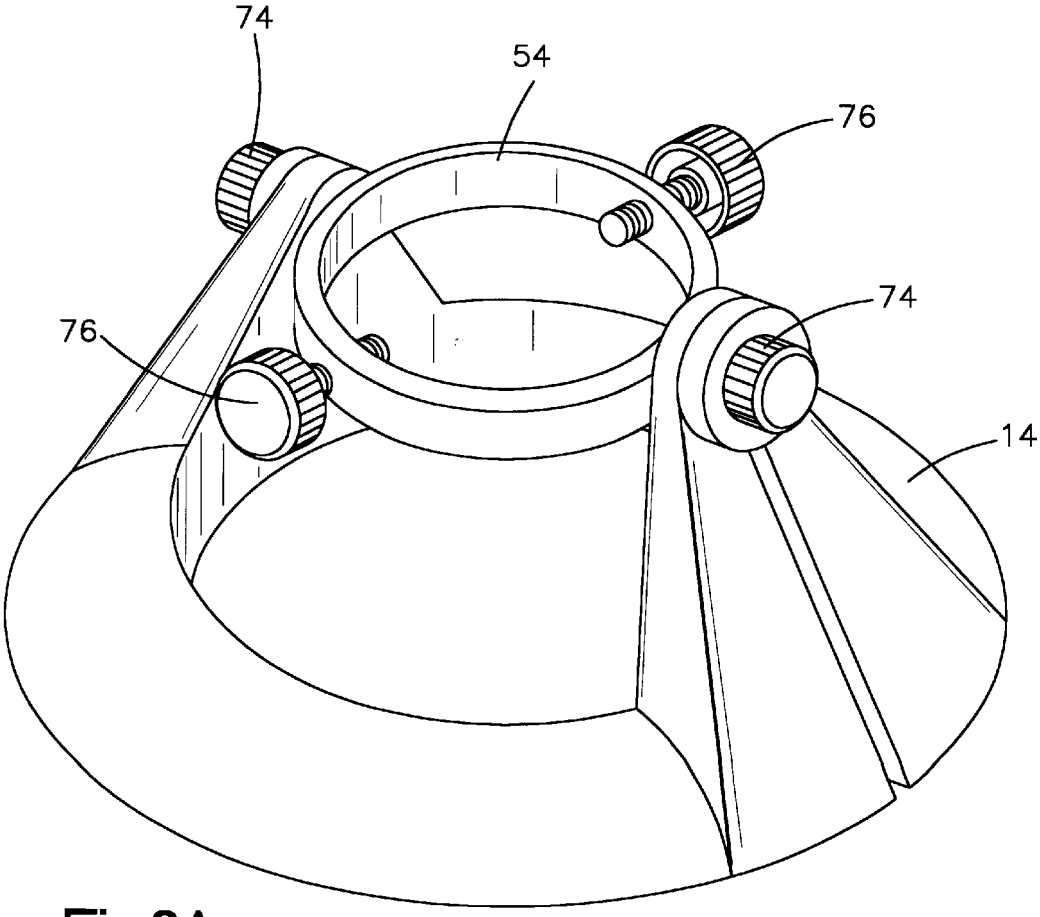
Figure 9B:
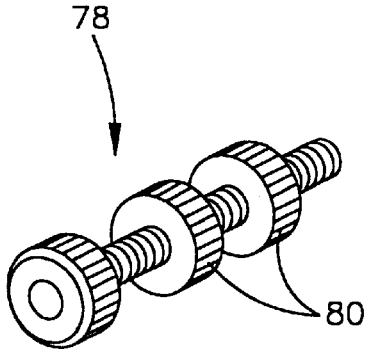
FIGS. 9A and 9B are schematic illustrations of a ninth embodiment of the inventive Christmas tree stand.
Figure 9A:
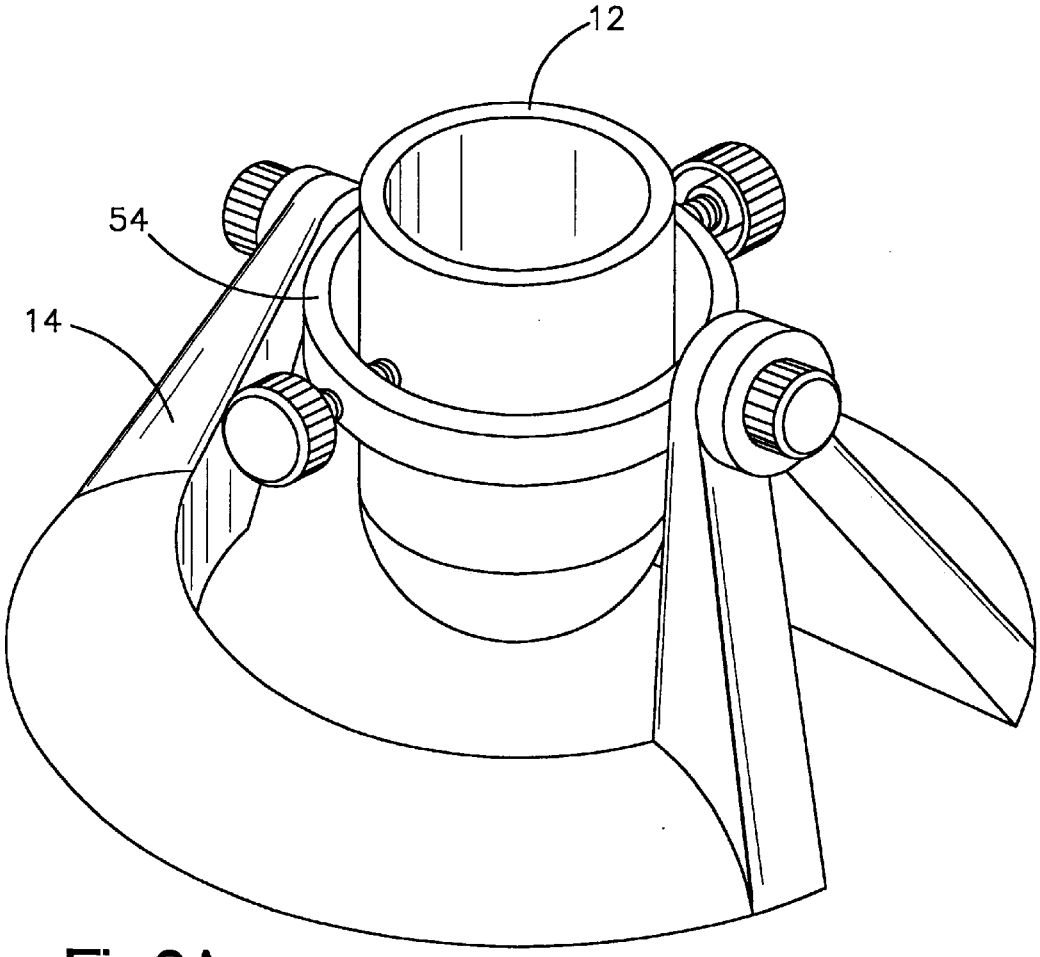

The embodiment illustrated in FIGS. 9A and 9B is similar to that of FIGS. 8A and 8B, except that in the embodiment of FIGS. 9A and 9B, a locking system 78 comprising two additional locking nuts 80, is provided on each of threaded fasteners 74 and 76 to prevent these threaded fasteners from becoming loosened over time.

Figure 10A:
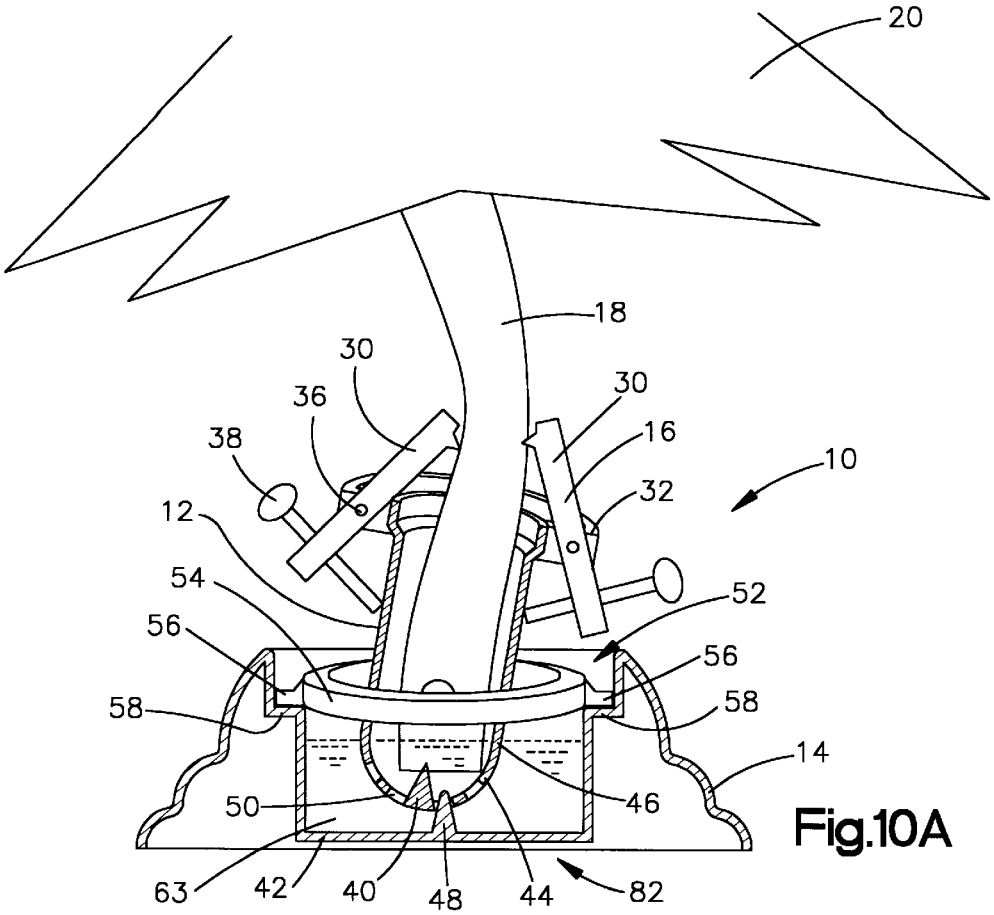
FIGS. 10A and 10B are schematic illustrations of a tenth embodiment of the inventive Christmas tree stand.
Figure 10B:
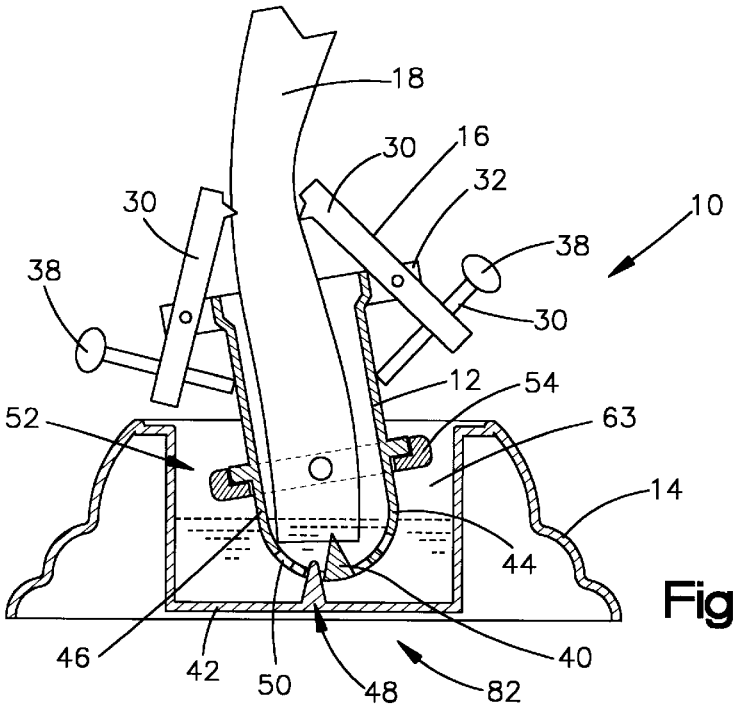
Figure 16A:
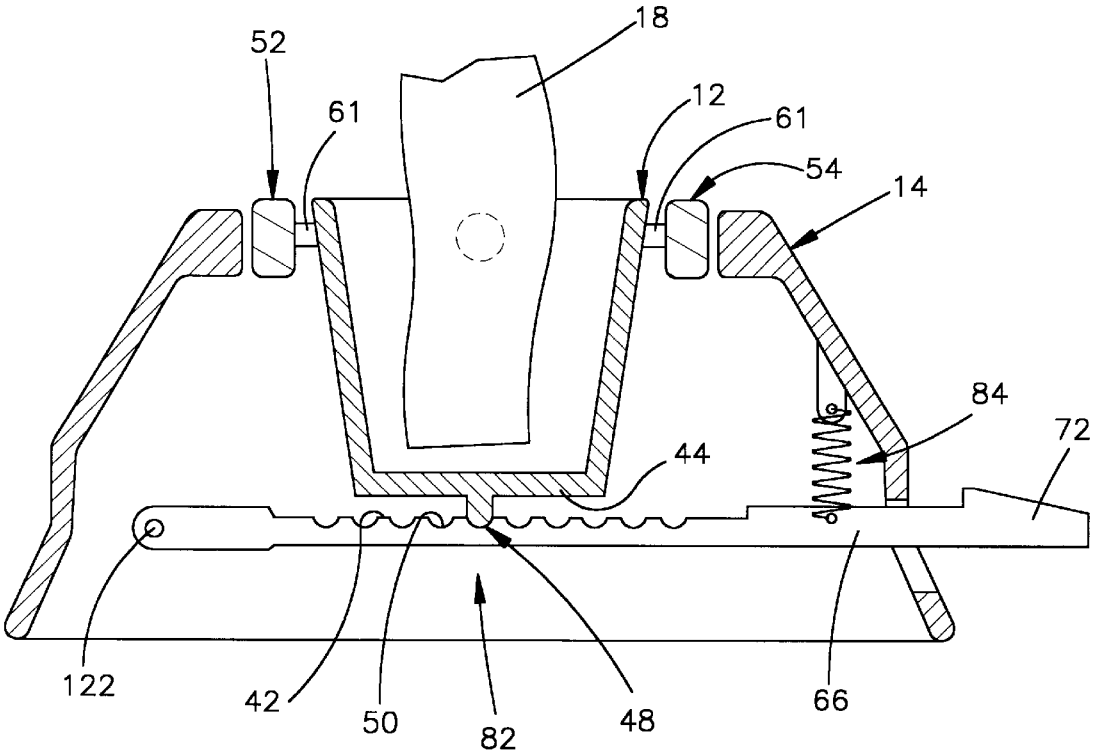
FIGS. 16A and 16B are schematic illustrations of a sixteenth embodiment of the inventive Christmas tree stand.
Figure 16B:
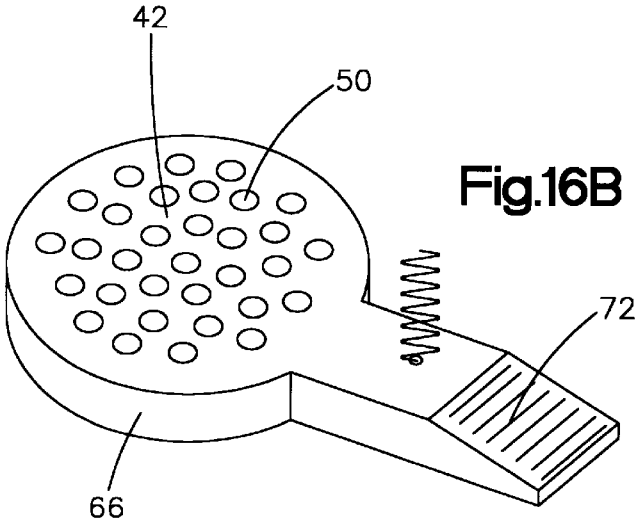

In the embodiment illustrated in FIGS. 16A and 16B, liquid tight receptacle 12 is mounted by universal joint 52 in a manner similar to that illustrated in connection with FIGS. 10A and 10B. In this embodiment, however, receptacle 12, once moved to its desired position, is locked in place by a locking assembly generally indicated at 82 which comprises projection 48 carried on base-mating surface 44 of receptacle 12 and indentations 50 received in receptacle-mating surface 42 of base 14. As shown in these figures, receptacle-mating surface 42 is formed in an upper surface of actuator 66 which is pivotally mounted on one end thereof at axis 122 and is provided on an opposite end thereof with a foot pedal 72 for actuation by the user. A spring 84 is provided to bias actuator 66 upwardly so that projection 48 in receptacle 12 engages, and is secured against lateral movement by, one of indentations 50 in the actuator. Depression of foot pedal 72 causes receptacle-mating surface 42 to be withdrawn from projection 48, thereby allowing receptacle 12 to be freely moved to any desired position for vertically positioning the tree. When foot pedal 72 is released, receptacle-mating surface 42 returns to its original position as illustrated in FIG. 16A with projection 48 being received in one of indentations 50 for securing receptacle 12 and tree 20 in proper position.

Referring to FIGS. 2A, 2B, 2C, 14A, 14B, 15 and 22, additional embodiments of the inventive Christmas tree stand are shown which, like the previously described embodiments, include a receptacle 12 mounted on a base 14, receptacle 12 having a clamping means 16 for securing the trunk 18 of a tree 20 therein. In the embodiment illustrated in FIGS. 2A, 2B, 2C and 22, receptacle 12 is mounted on base 14 by means of a ball and socket arrangement 86. Preferably, ball and socket arrangement 86 allows receptacle 12 to freely pivot about horizontal, perpendicular X and Y axis, but not to rotate about a vertically-oriented Z axis. In these embodiments, pivot point 88 defined by the ball and socket is located below the chamber 90 of receptacle 12. In the embodiments illustrated in FIGS. 14A, 14B and 15, receptacle-mating surface 42 of the base and base-mating surface 44 of the receptacle define mating sections of spheres so that the receptacle can slidably move in the base in any direction. In these embodiments, receptacle 12 pivotally moves on base 14 about pivot point 88 which is located within chamber 90 of the receptacle along the central vertical axis of base 12 and at the center of the spheres defining base-mating surface 44 and receptacle-mating surface 42.

Because receptacle 12 is pivotally mounted on base 14 in each of these embodiments, at least some portion of receptacle 12 is laterally moveable with respect to base 14. In the particular embodiments shown, it is the upper portion of receptacle 12, i.e. that portion of receptacle 12 above pivot point 88, which is laterally movable. Accordingly, in each of these embodiments, a locking assembly is provided with locking members adapted to engage or abut the laterally moveable portion of the receptacle to lock the receptacle in place once the receptacle has been moved to the desired position for vertically positioning the tree.

Figure 2A:
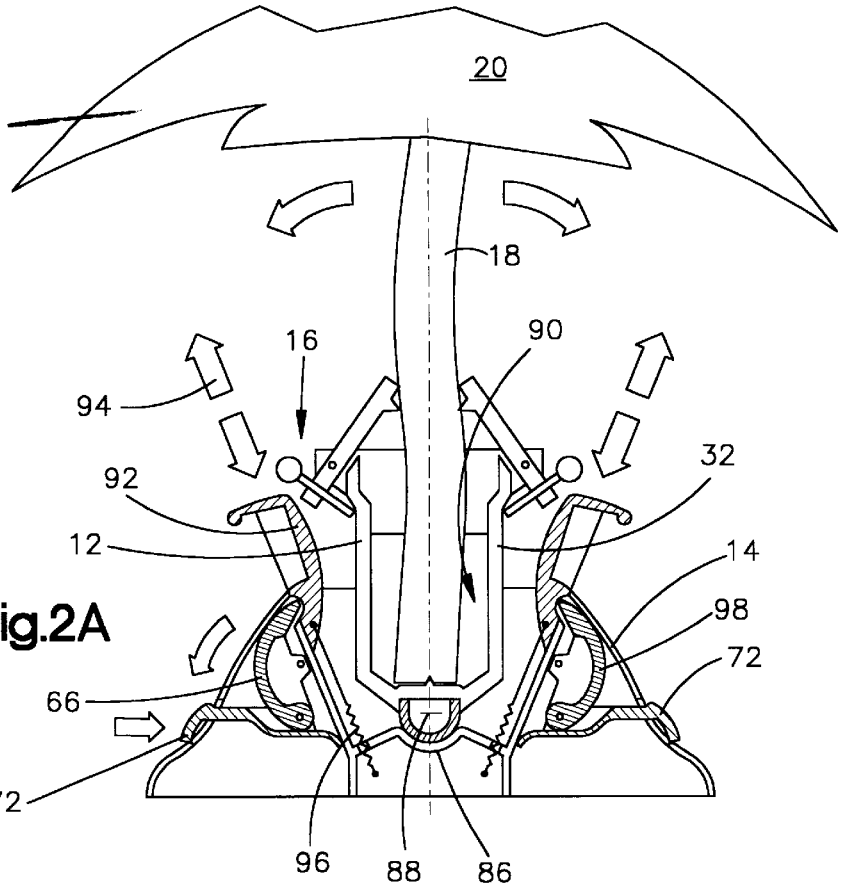
FIGS. 2A, 2B and 2C are schematic illustrations of a second embodiment of the inventive Christmas tree stand.
Figure 2B:
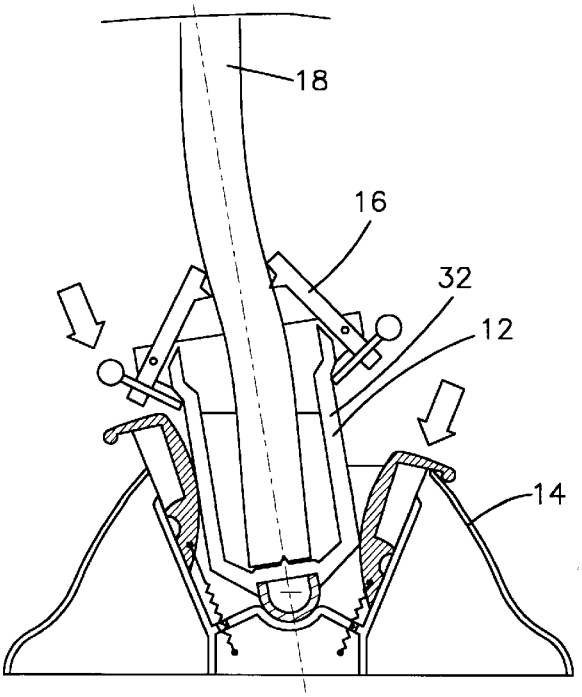
Figure 2C:
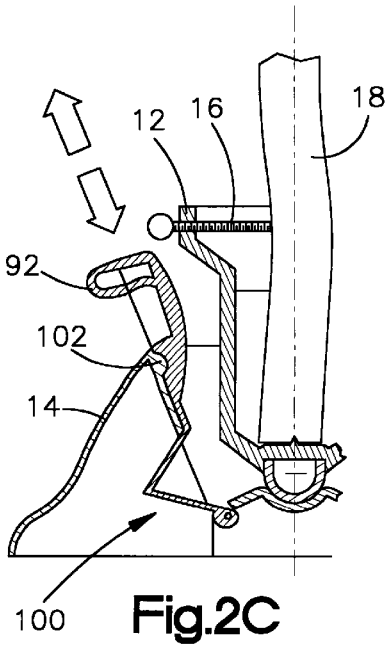

In the embodiment illustrated in FIGS. 2A, 2B and 2C, the locking members comprise wedges 92 which are moveable in the direction of arrows 94 for engaging the sides of receptacle 12 to prevent lateral movement of the receptacle once the proper position of the receptacle has been determined. In the embodiment of FIG. 2A, wedges 92 are biased downwardly by springs 96. In use, wedges 92 are moved upwardly against the bias of spring 96 and are locked in place by locking elements or actuators 66 which take the form of pivotally mounted crescents 98, one crescent 98 being provided for each wedge 92. An associated foot pedal 72 is operatively attached to each of crescents 98 which, when depressed, will cause each crescent 98 to disengage from its associated wedge 92, thereby allowing associated spring 96 to draw wedge 92 downwardly to the position illustrated in FIG. 2B.

In use, wedges 92 are each drawn upwardly and locked into an open position by crescents 98. Then the user inserts tree 20 with receptacle 12 attached into base 12 and moves tree 20 to the desired vertical position. Then, the user depresses each of foot pedals 72, which in turn causes each of associated springs 96 to draw wedges 92 downwardly into contact with the sides of receptacle 12, the final position of each wedge being dependent on the position of the receptacle with respect to the base as illustrated in FIG. 2B. Once wedges 92 are in place, as shown in this figure, they secure the upper portion of receptacle 12 from lateral movement and hence lock receptacle 12 and tree 20 in proper position. In a similar version of this embodiment, a single foot pedal can be used to actuate all of the wedges simultaneously.

In the embodiment of FIG. 2C, leaf spring 100 is provided to bias wedge 92 downwardly. In addition, locking of wedges 92 in an open position is accomplished by means of an engagement section comprising indentations designed into wedges 92 which cooperate with shoulders 102 designed into base 14. With this structure, each of wedges 92 rests in an open position by virtue of the indentation therein being carried on its associated shoulder on base 14. When the user decides to secure receptacle 12 in place, slight movement of the wedges toward the center of the stand caused the indentations therein to clear their associated shoulder and thereby be drawn into locking position as illustrated in FIG. 2B by leaf spring 100.

Figure 14A:
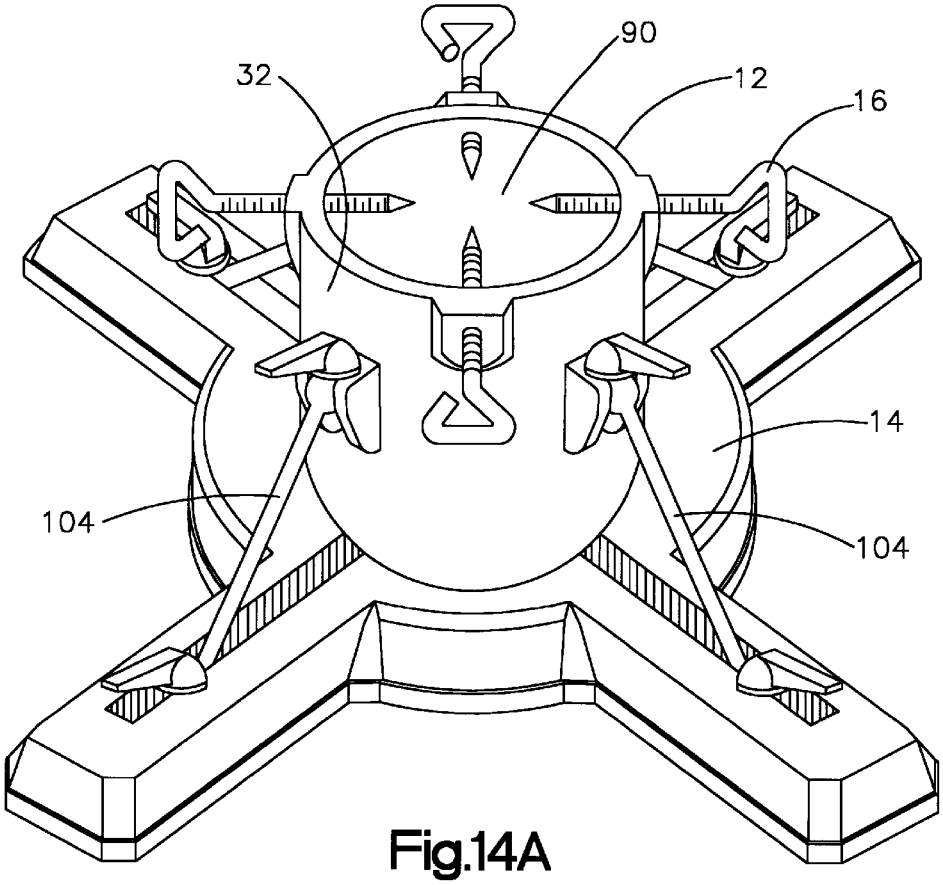
FIGS. 14A and 14B are schematic illustrations of a fourteenth embodiment of the inventive Christmas tree stand.
Figure 14B:
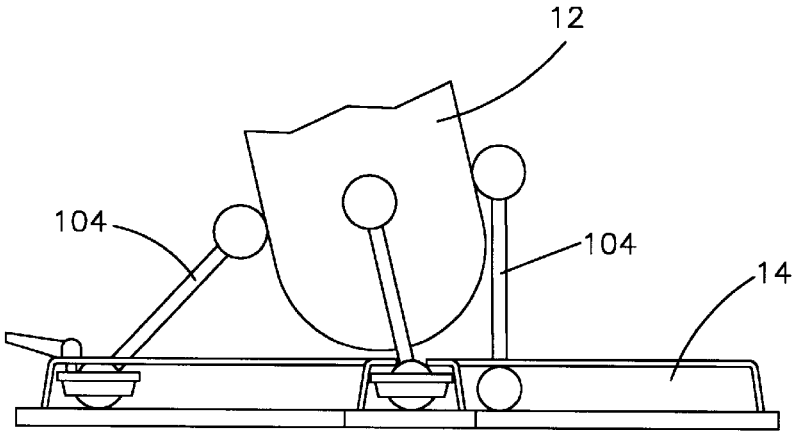
Figure 15:
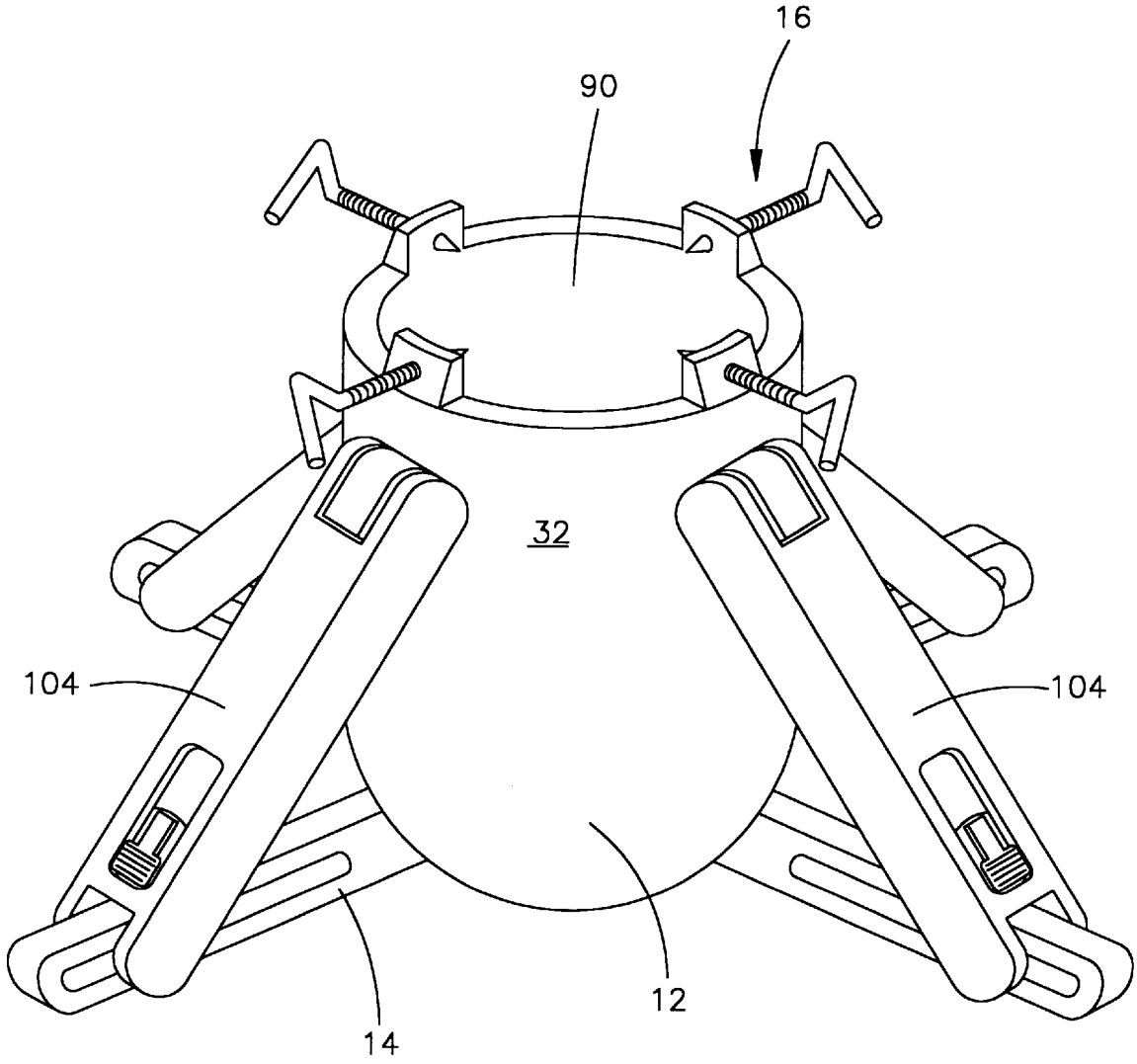
FIG. 15 is a schematic illustration of a fifteenth embodiment of the inventive Christmas tree stand.

In the embodiments illustrated in FIGS. 14A, 14B and 15, a plurality of independently adjustable locking arms 104 are provided to prevent lateral movement of the upper portion 32 of liquid-tight receptacle 12. In both embodiments shown, the upper end of locking arms 44 are pivotally mounted to upper portion 32 of receptacle 12, while the lower ends of the locking arms are slidably engaged in base 14. Of course, the pivotal and slidable mountings at the ends of locking arms 104 can be reversed, if desired. Each of locking arms 104 is provided at its slidable end with an independently actuated locking element 106 to lock the slidable end of a locking arm in place, which in turn secures receptacle 12 in place with tree 20 in its desired vertical position.

In an alternative arrangement of the embodiment illustrated in FIGS. 14A and 14B, locking arms 104 are pivotally mounted at upper portion 32 of receptacle 12 (or base 14) by ball and socket arrangements which allow the balls to be withdrawn from the sockets. This enables receptacle 12 to be releasably mounted on base 14, thereby allowing the receptacle to be mounted to tree 20 before the receptacle and the tree are mounted to the base.

Figure 22:
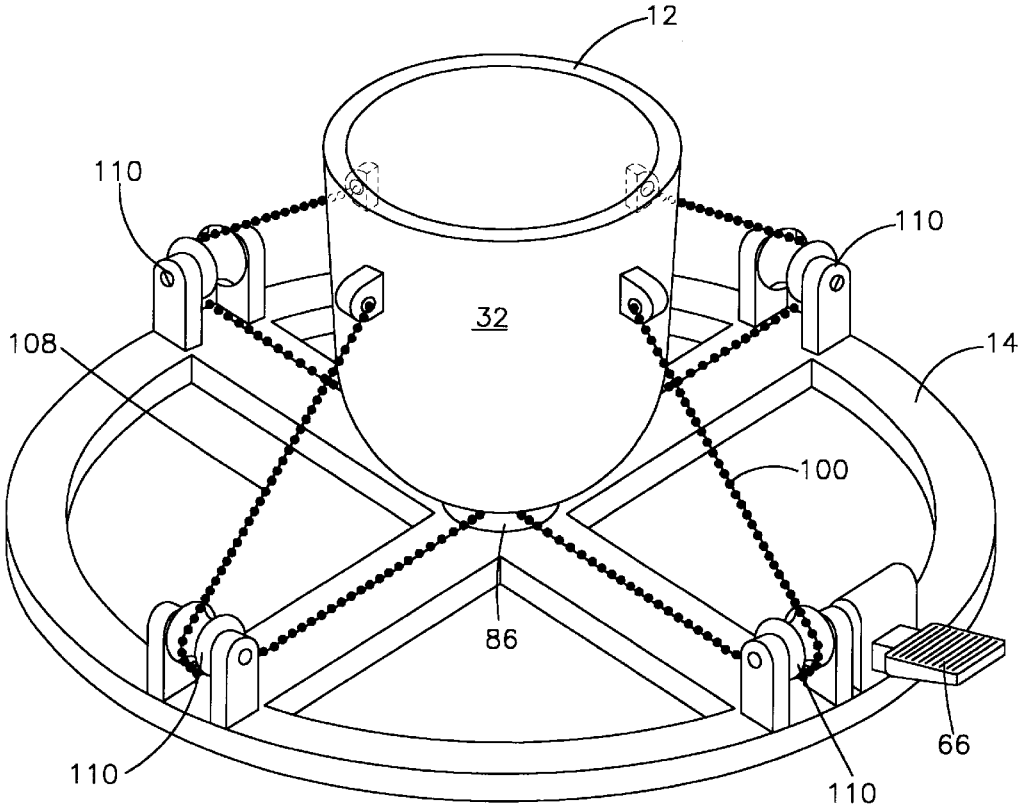
FIG. 22 is a schematic illustration of a twenty-second embodiment of the inventive Christmas tree stand.

The embodiment illustrated in FIG. 22 is similar to the embodiments illustrated in FIGS. 14A, 14B and 15, except that in the embodiment of FIG. 22 locking arms 104 are replaced with locking lines 108. Locking lines 108, which may comprise chains, ropes, wires, strings, or other similar devices, are adjustably mounted in stops 110 which are adapted to secure locking lines 108 in place when in a locking position. Locking lines 108 are attached on one end thereof to the upper portion 32 of receptacle 12 and on the other end thereof to a tensioning means not shown. Actuator 66 in the form of a foot pedal is provided for actuating all of stops 110 at the same time, i.e. moving stops 110 from a locking position wherein they securely hold respective locking lines 108 to a disengaged position in which they allow locking lines 108 to freely travel therethrough.

In use, trunk 18 of tree 20 is placed in receptacle 12 and clamped therein by a clamping means not shown. Then, with actuator 66 depressed, receptacle 32 is moved to a desired position for vertically positioning the tree. As this occurs, the tensioning means, not shown, automatically adjusts the links of locking lines 108 between upper portion 32 of receptacle 12 and stops 110. When receptacle 12 is moved to its desired position, actuator 66 is released, at which time stops 110 securely engage locking lines 108, thereby securely holding receptacle 12 in place.

Figure 3:
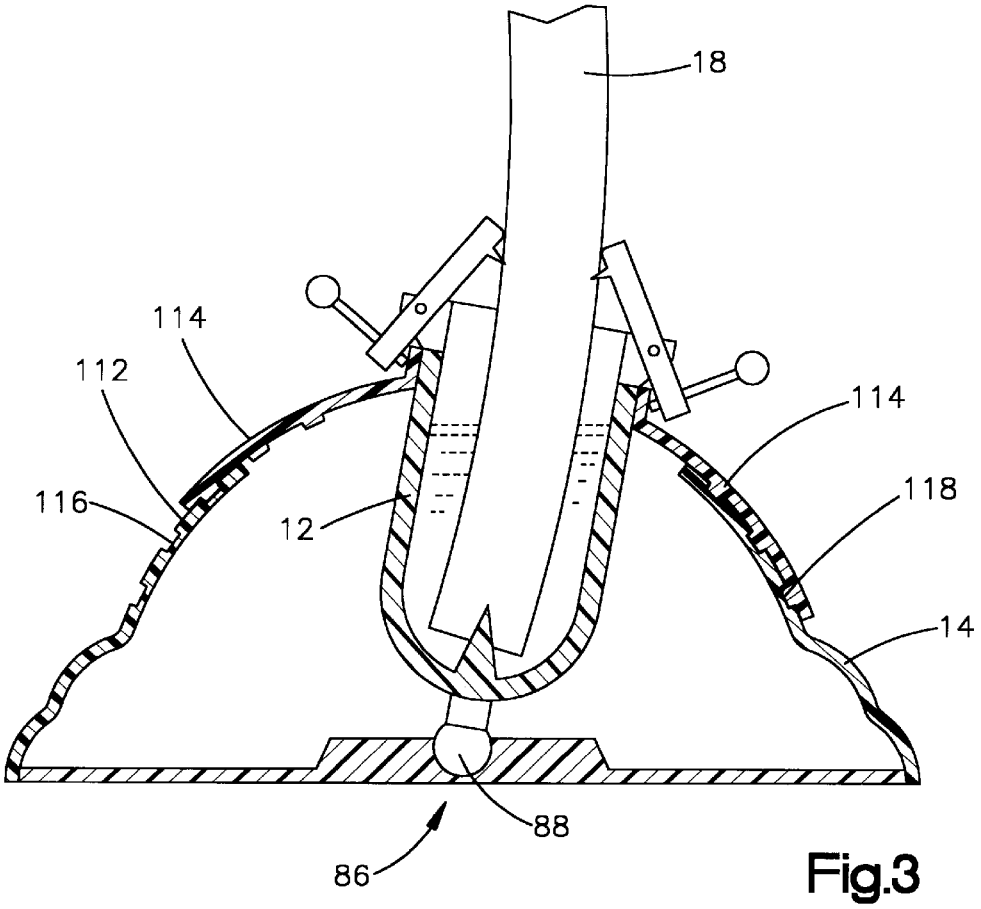
FIG. 3 is a schematic illustration of a third embodiment of the inventive Christmas tree stand.

FIG. 3 illustrates still another embodiment of the inventive Christmas tree stand. In this embodiment, receptacle 12 is pivotally mounted in base 14 about pivot point 88 by means of ball and socket arrangement 86. Base 14 includes an upper spherical surface 112, while receptacle 12 includes an integral spherical skirt 114 in mating engagement therewith. Upper spherical surface 112 of the base and spherical skirt 114 are defined by sections of spheres centered about pivot point 88. In addition, they define a locking assembly comprising a mating system of indentations 116 and projections 118 for locking receptacle 12 in place with respect to base 14 when tree 20 is moved to its desired vertical position.

Figure 4:
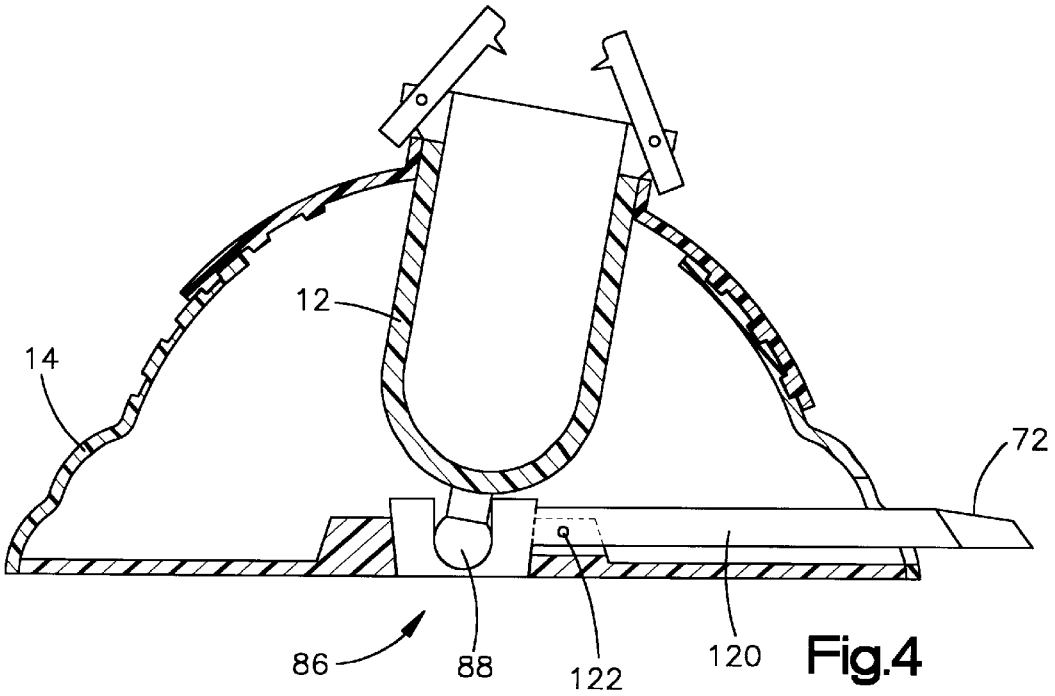
FIG. 4 is a schematic illustration of a fourth embodiment of the inventive Christmas tree stand.

The embodiment illustrated in FIG. 4 is similar to that illustrated in FIG. 3, except that in the embodiment of FIG. 4, the socket of ball and socket 86 is mounted on lever arm 120 for pivotal movement about axis 122. By actuating lever arm 120 through depression of pedal 72 attached thereto, the user can move receptacle 12 with tree 20 therein to its desired position with the weight of the receptacle and the tree being supported by ball and socket 86. Once the tree is moved to its desired vertical position, release of foot pedal 72 will cause projections 118 to mate within indentations 116, thereby locking receptacle 12 in place.

Figure 5A:
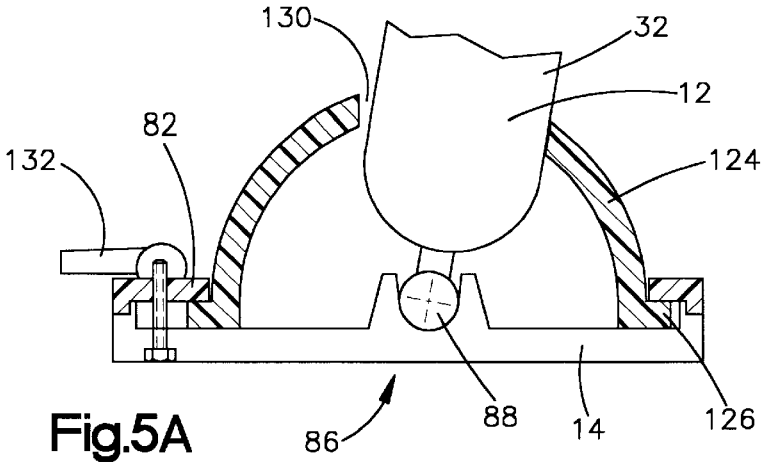
FIGS. 5A, 5B and 5C are schematic illustrations of a fifth embodiment of the inventive Christmas tree stand.
Figure 5B:
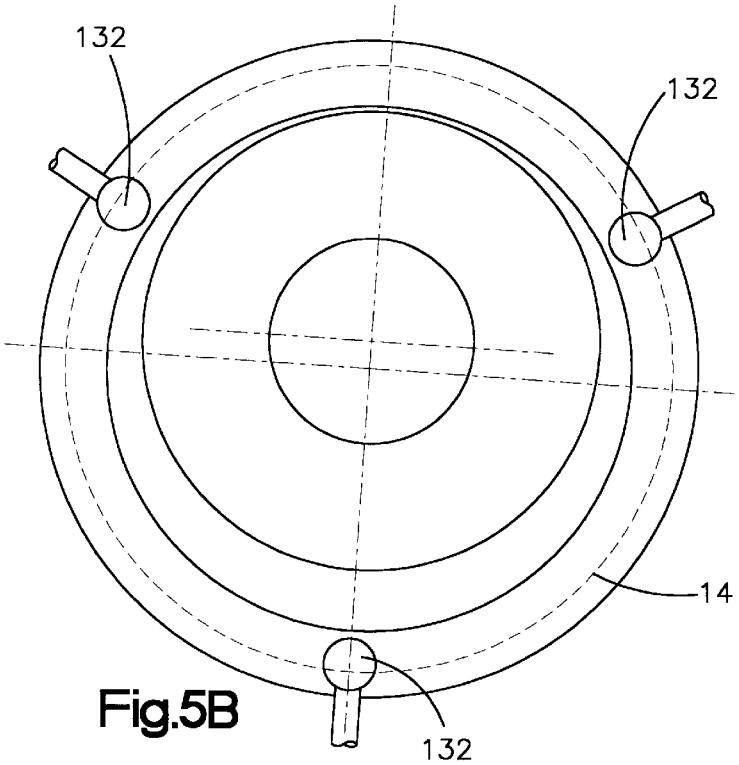
Figure 5C:
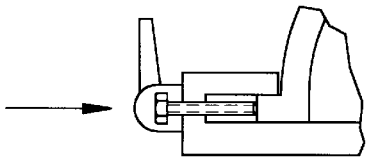

FIGS. 5A, 5B and 5C illustrates still another embodiment of the present invention. In this embodiment, liquid-tight receptacle 12 is pivotally mounted on a base 14 for pivotal movement about a pivot point 88 by means of a ball and socket arrangement 86. A locking assembly comprising an engagement section in the form of a hemispherical member 124 is mounted on base 14, with the bottom 126 of hemispherical member 124 being horizontally slidable along base 14 in any direction. Top 128 of hemispherical member 124 defines an opening 130 therein which receives upper portion 32 of receptacle 12. Locking assembly 82 also includes locking elements 132 for locking bottom 126 of hemispherical member 124 in place with respect to base 14 at three separate locations, as illustrated in FIG. 5B.

With this structure, receptacle 12 with tree 20 mounted therein can be mounted on base 14 by means of ball and socket arrangement 86. With locking elements 132 in a disengaged position, receptacle 12 is then moved to any desired position for vertically positioning tree 20. In so doing, hemispherical member 124 slidably moves along base 14 in any horizontal direction so as to properly position opening 130 with respect to pivot point 88. When receptacle 12 is moved to the desired position, locking elements 132 are then locked in place, thereby causing engagement section or hemispherical member 124 to hold receptacle 12 in place.

Figure 6A:
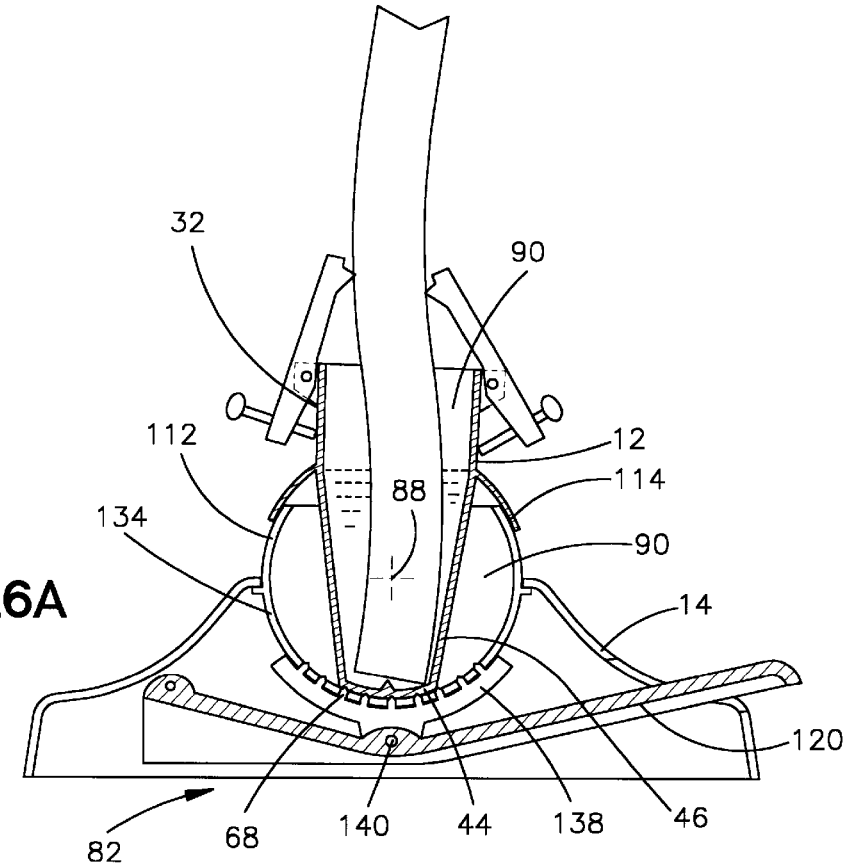
FIGS. 6A and 6B are schematic illustrations of a sixth embodiment of the inventive Christmas tree stand.
Figure 6B:
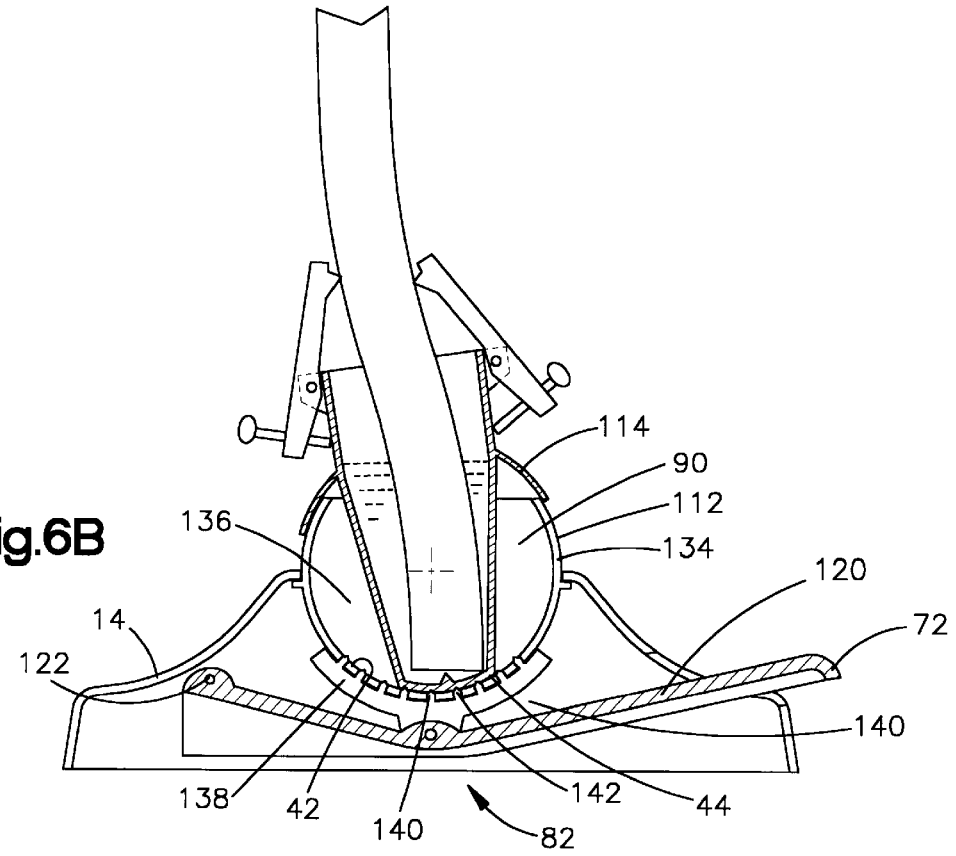
Figure 7:
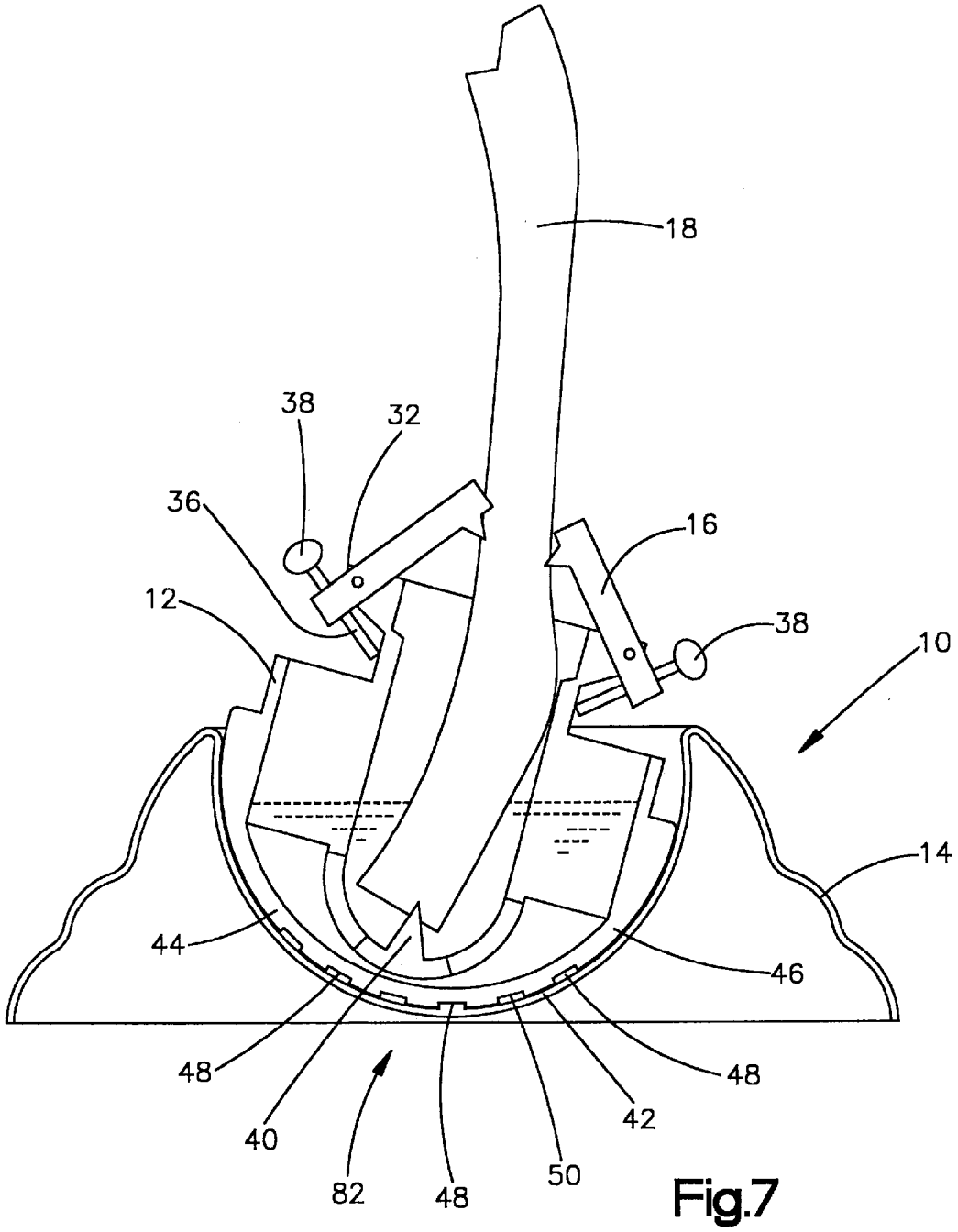
FIG. 7 is a schematic illustration of a seventh embodiment of the inventive Christmas tree stand.

FIG. 6 illustrates still another embodiment of the inventive Christmas tree stand. In this embodiment, spherical wall 134 in base 14 defines an essentially spherical chamber 90 inside base 14 as well as an upper spherical surface 112 of the base having an opening therein for receiving receptacle 12. Receptacle 12, in turn, includes a base-mating surface 44 therein, which is spherical in configuration for matingly engaging receptacle-engaging surface 42 of base 14, which is defined by spherical wall 134 of the base. In addition, receptacle 12 also includes a spherical skirt 114 integral therewith for mating engagement with upper spherical surface 112 of base 14. With this structure, receptacle 12 pivots about a pivot point 88 located within chamber 90 of receptacle 12, with a significant portion of the weight of receptacle 12 and tree 20 being carried by receptacle-mating surface 42 of base 14 and another significant portion of the weight of receptacle 12 and tree 20 being carried by upper spherical surface 112 of base 14.

A locking assembly generally indicated at 82 comprises a spherical locking pad 138 which defines a series of projections 140 thereon. Openings are provided in spherical wall 134 of base 14 to allow projections 140 in locking pad 138 to pass therethrough and enter spherical chamber 136. A series of indentations 142 is defined in base-mating surface 44 of the receptacle to receive corresponding projections 140.

Spherical locking pad 138 is mounted on an actuator in the form of a lever arm 120 which is pivotally mounted on axis 122 and provided on its other end with a foot pedal 72. Spring means (not shown) is provided to bias lever arm 120 in the position illustrated in FIGS. 6A and 6B, with projections 140 on locking pad 138 engaging indentations on base-mating surface 44 of receptacle 12.

In use, receptacle 12, after being separately mounted to trunk 18 of tree 20, is placed on base 14. With foot pedal 72 depressed, receptacle 12 is moved to a desired position for vertically positioning the tree. In so doing, the weight of the receptacle and the tree is supported both at the top and the bottom of the receptacle by spherical skirt 114 and base-mating surface 44 of the receptacle. Once receptacle 12 is moved to the desired position, foot pedal 12 is released. This causes projections 140 on locking pad 138 to engage indentations on base-mating surface 44 of the receptacle, thereby locking the receptacle in place.

Figure 18A:
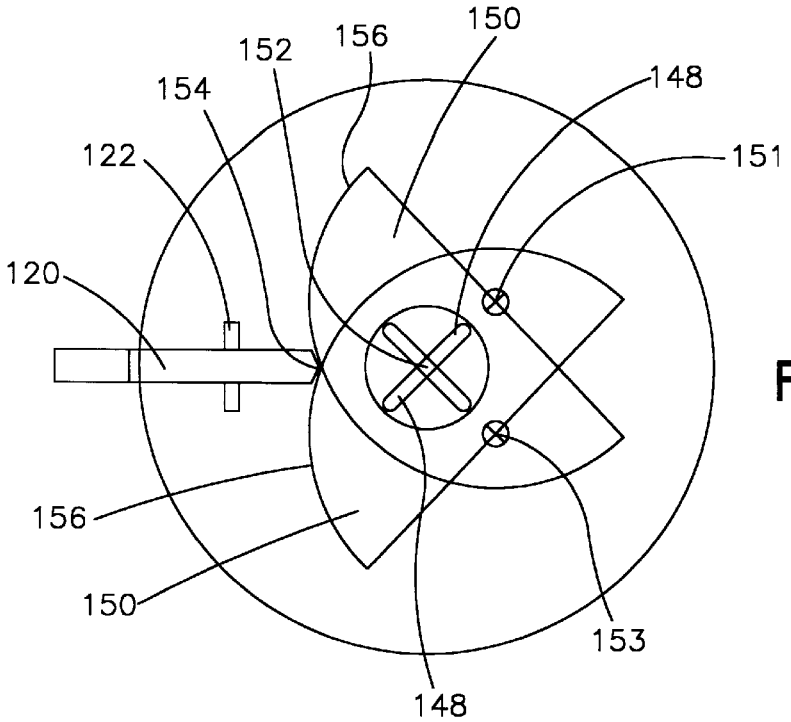
FIGS. 18A, 18B and 18C are schematic illustrations of an eighteenth embodiment of the inventive Christmas tree stand.
Figure 18B:
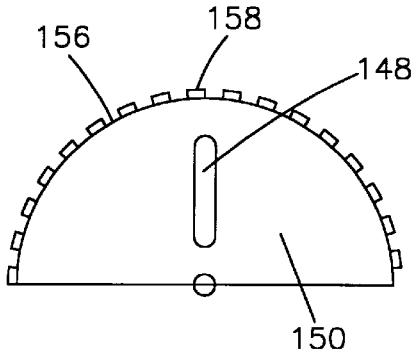
Figure 18C:
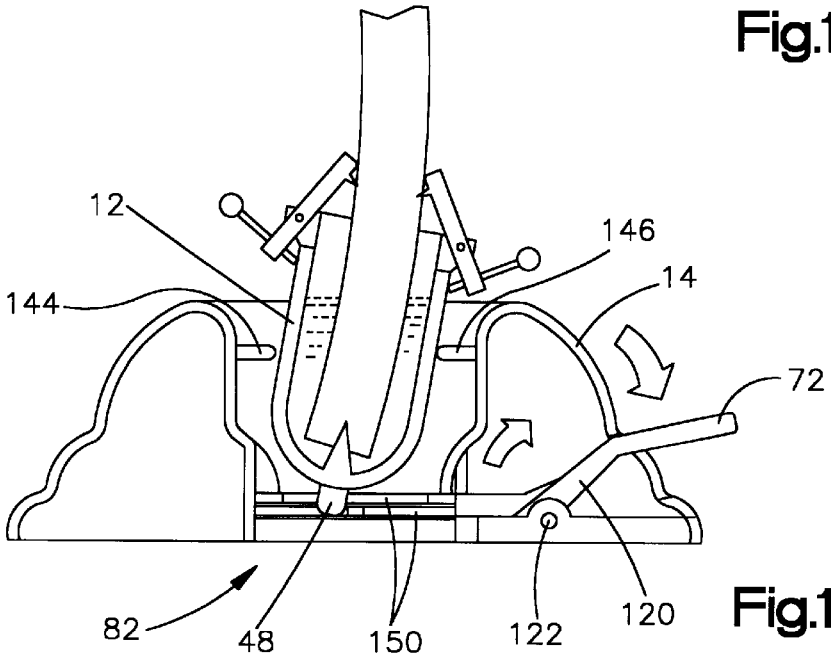
Figure 19A:
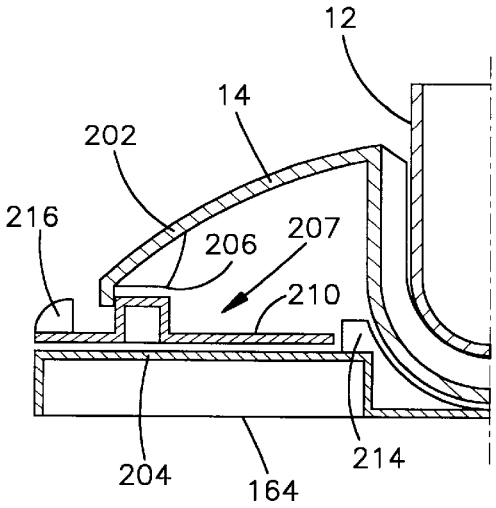
FIGS. 19A, 19B, 19C and 19D are schematic illustrations of a nineteenth embodiment of the inventive Christmas tree stand.
Figure 19B:
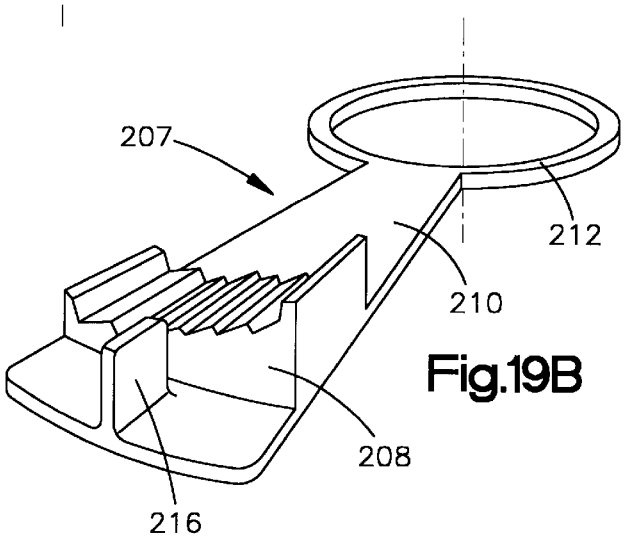
Figure 19C:
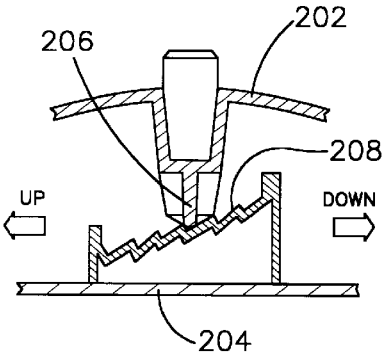
Figure 19D:
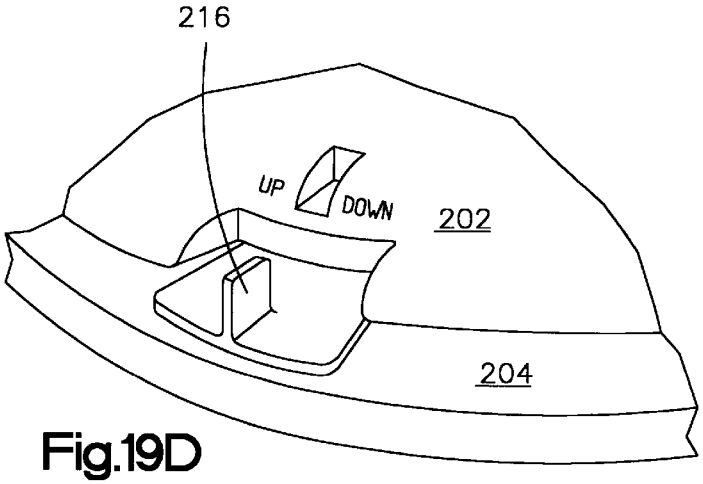

Still another embodiment of the inventive Christmas tree stand is illustrated in FIGS. 18A, 18B and 18C. In this embodiment, receptacle 12 is received in an opening 144 defined by circumferential lip 146 in an upper portion of base 14. If desired, receptacle 12 can be mounted on base 14 by a universal joint arrangement such as illustrated in connection with FIGS. 11A and 11B. The bottom of receptacle 12 defines a projection 48 thereon which is received in a locking assembly generally indicated at 82. Locking assembly 82 takes the form of two positioning members 150 which are laterally moveable in base 14, each positioning member 115 defining an opening 148 therein for receiving projection 48 of receptacle 12. In the embodiment shown, both positioning members 150 comprise essentially flat, half-plate members which are horizontally disposed and mounted for rotable movement in base 14 about respective pivot axes 151 and 153. As shown in FIG. 18A elongated slots 148 in each positioning member 150 cooperate to define an opening 152 for receiving projection 148 of receptacle 12.

An actuator in the form of lever arm 120 is adapted at its distal end 154 to engage circumferential surface 156 of each positioning member. As illustrated in FIG. 18B, circumferential surface 156 of each positioning member can be provided with projections 158 for enhancing engagement with distal end 154 of locking arm 120, if desired. As illustrated in FIG. 18C, locking arm 120 is pivotally attached to base 14 at axis 122 and is normally biased by biasing means (not shown) in the position illustrated in FIG. 18C. In this position, locking arm 120 secures positioning members 150 in place, thereby preventing lateral movement of projection 48 received therein.

In use, receptacle 12 with tree 20 received therein is placed in base 14, with projection 48 being received in opening 152 defined by both positioning members 150. Foot pedal 172 is then depressed, which frees positioning members 150 to rotably move in base 14. This allows the user to move receptacle 12 to any desired position for vertically positioning the tree. Once the desired position for receptacle 12 is achieved, foot pedal 72 is released. This causes lever arm 120 to lock positioning members 150 in place, which in turn locks receptacle 12 in place by means of projection 48 thereon.

Figure 12A:
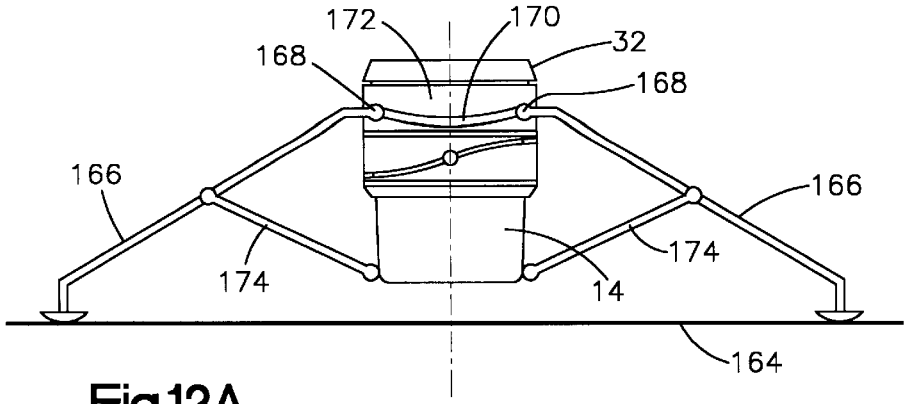
FIGS. 12A, 12B and 12C are schematic illustrations of a twelfth embodiment of the inventive Christmas tree stand.
Figure 12B:
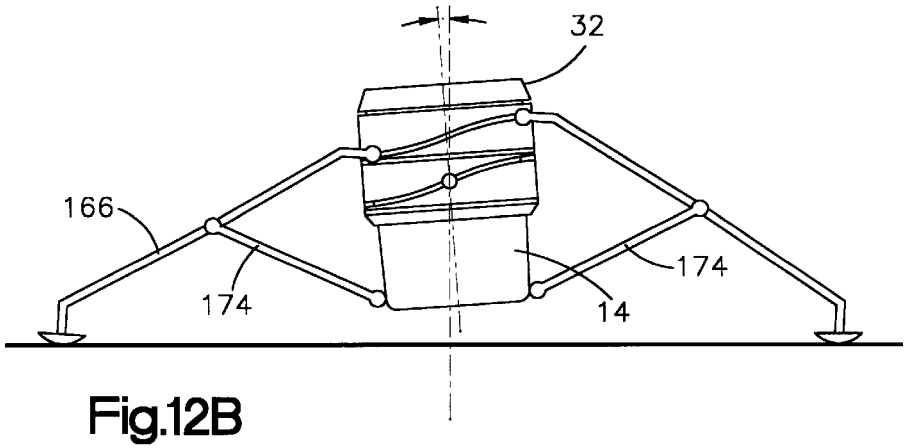
Figure 12C:
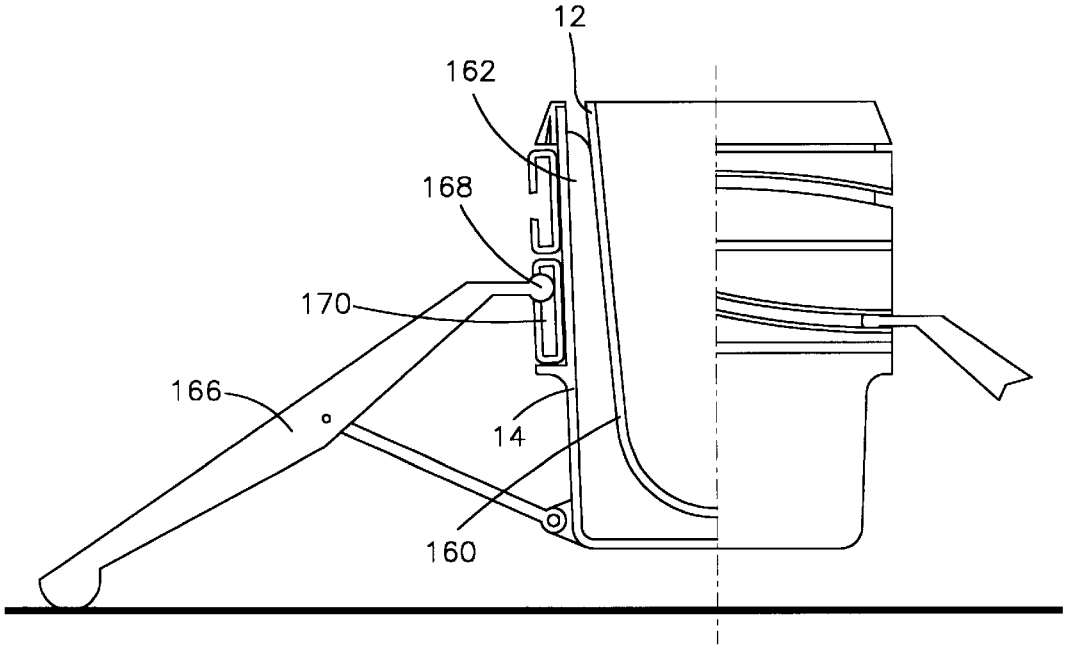

FIGS. 12A, 12B and 12C show yet another embodiment of the inventive Christmas tree stand. In this embodiment, as shown in FIG. 12C, receptacle 12 takes the form of a container having a clamping assembly (not shown) in an upper portion thereof. The lower portion of receptacle 12 is defined by a plurality U-shaped member 160 which are received between and supported by a plurality of fins 162 in base 14. Base 14 is supported off the ground or floor 164 by a plurality of support legs 166.

Each of support legs 166 on one end thereof engages floor 164, while the other end thereof terminates in a ball 168 which is slidably received in a groove 170 in an adjustment ring 172 rotably attached to base 14. Link 174 is pivotally attached on one end to the bottom of base 14 and on its other end to a central portion of support leg 166.

Grooves 170 in adjustment rings 172 are so arranged that balls 168 carried on the upper ends of support leg 166 move up or down depending on the position of adjustment ring 72. This, in turn, causes the other end of support leg 166 to move up or down as adjustment ring 72 is moved to different positions, which in turn causes base 14 to tilt towards or away from each adjustment leg, as illustrated in FIG. 12B. By suitable positioning of each of adjustment rings 172, the position of base 14 and hence receptacle 12 can be changed so that tree 20 can be vertically positioned as desired.

In the particular embodiment shown, base 14 is provided with four legs arranged in two pairs, the legs of a first of these pairs engaging a first adjustment ring with the legs of the other pair engaging a second adjustment ring. In addition, the grooves in each adjustment ring are configured so that when one leg of the pair is in a fully down or extended position, the other leg of that pair is in a fully up or retracted position. By this means, proper positioning of tree 20 can be facilitated.

Figure 13A:
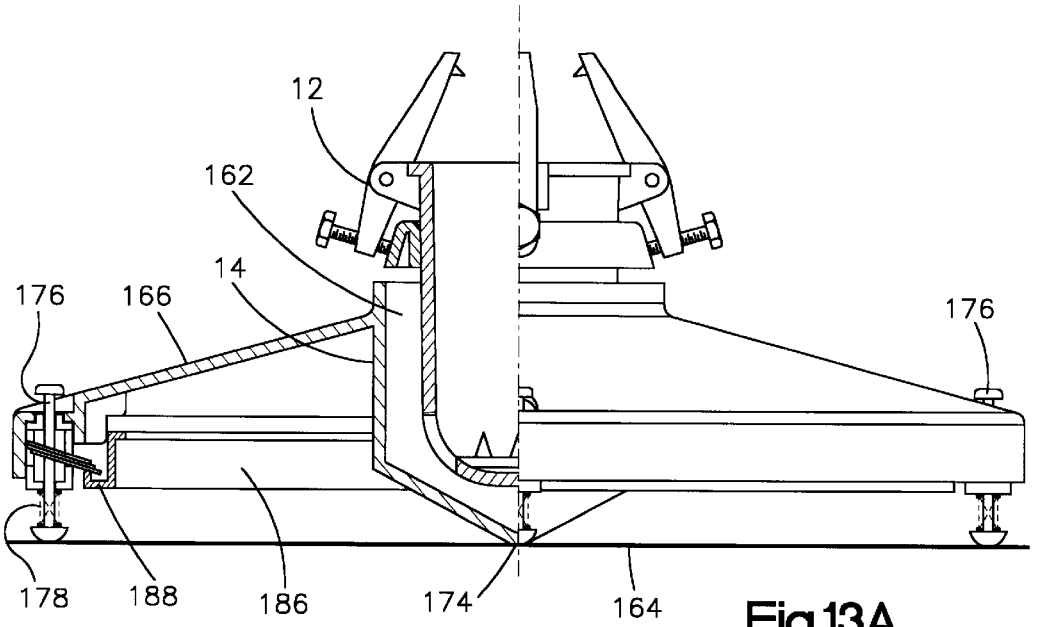
FIGS. 13A, 13B and 13C are schematic illustrations of a thirteenth embodiment of the inventive Christmas tree stand.
Figure 13C:
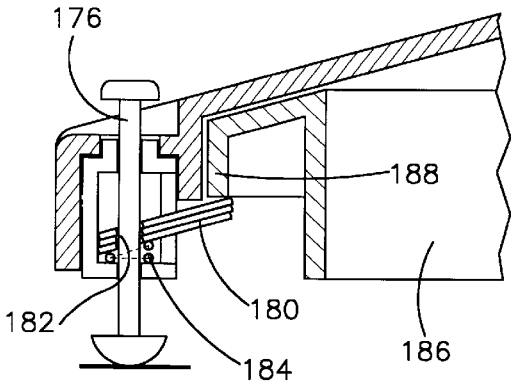
Figure 13B:
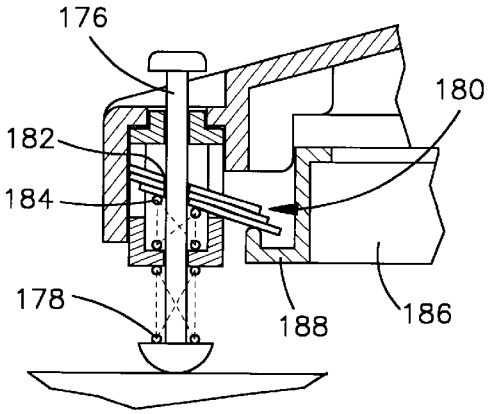

FIGS. 13A, 13B and 13C illustrate still another embodiment of the present invention. In this embodiment, receptacle 12 is received in base 14 by means of a plurality of fins 162 in base 14. In addition, base 14 includes a plurality of support legs 166 rigidly attached to a central portion of base 14. In addition, the bottom of base 14 in a central portion thereof defines an abutment 174 such that base 14 can pivot on floor 164 about abutment 174 for vertically positioning tree 20 secured in receptacle 12.

Each of support legs 166 includes a vertically disposed support rod 176 at a remote end thereof, each support rod being independently moveable in a vertical direction. A spring 178 is provided to bias each of support rods 176 downwardly.

A locking assembly comprising at least one washer 180 is provided for locking each support rod 176 in place. Support rods 176 are received in the central openings 182 of washers 180 and a spring 184 is provided to bias washers 180 so that they are arranged at an acute angle with respect to the central axis of the associated bolt rather than perpendicular thereto. This serves to prevent vertical movement of each support rod 176, thereby locking the support rod in place in base 14.

In the embodiments illustrated in FIGS. 13A and 13B, an actuator comprising actuator ring 186 having a lip 188 thereon engaging washers 180 is provided. Actuator ring 186 is normally biased downwardly in the position shown in FIGS. 13A and 13B by biasing means (not shown) . A foot pedal (also not shown) is provided to raise actuator ring 186 when desired. In use, receptacle 12 including tree 120 secured therein is placed in base 14. Then, the foot pedal attached to actuator ring 186 is depressed. This causes actuator ring 186 to be raised, which in turn causes lip 188 to move washers 180 so they are at or near a horizontal position, i.e. perpendicular or almost perpendicular to support rods 176. This allows support rods 176 to vertically move in support legs 66 for vertically positioning tree 20. Once tree 20 is moved to the desired vertical position, the foot pedal is released. Actuator ring 186 then returns to its position as illustrated in FIGS. 13A and 13B and, as a result, springs 184 cause washers 180 to lock support rods 176 in place for securely positioning receptacle 12 and tree 20 in position.

The embodiment illustrated in FIG. 13C is similar to that illustrated in FIGS. 13A and 13B except that the angle of washers 180 has been reversed. In addition, the operation of actuator ring 186 is also reversed in that it is normally biased in an up position and when actuated moves downwardly so as to engage washers 180.

Figure 17A:
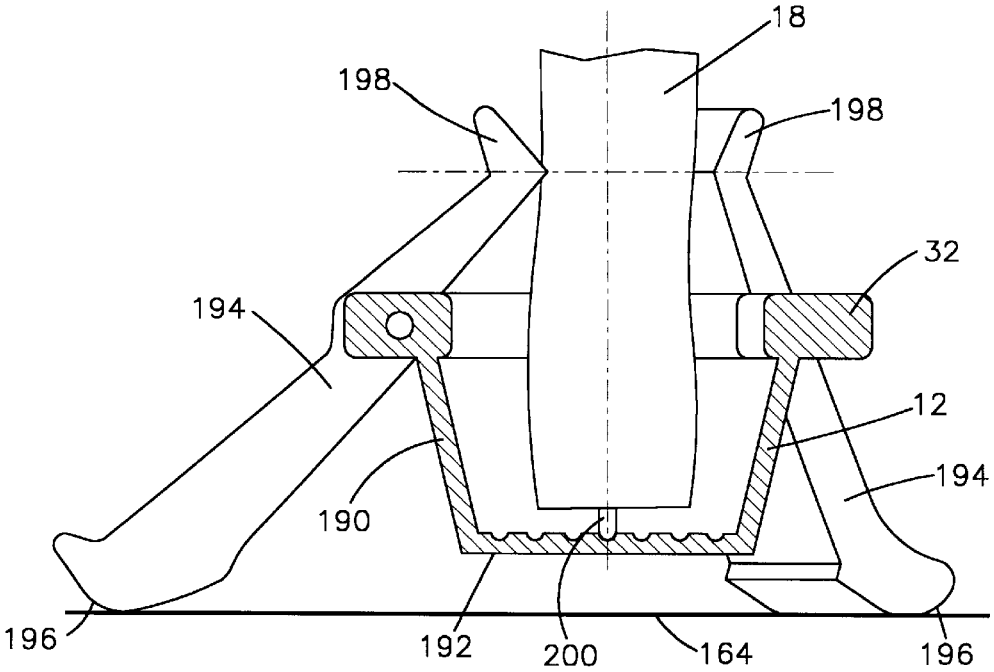
FIGS. 17A and 17B are schematic illustrations of a seventeenth embodiment of the inventive Christmas tree stand.
Figure 17B:
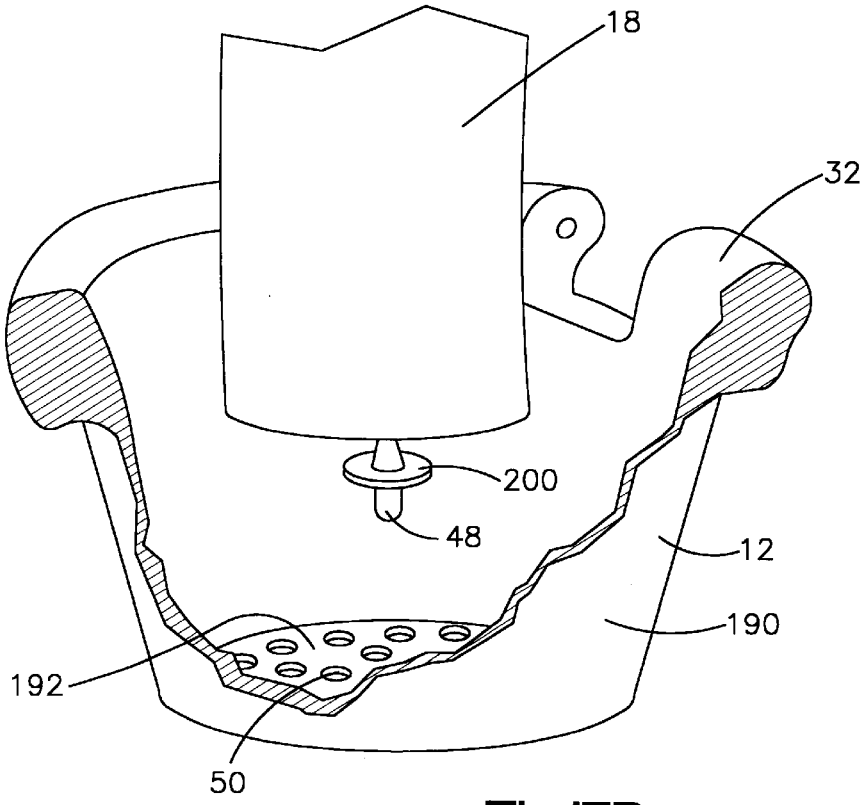

FIGS. 17A and 17B illustrate still another embodiment as the inventive Christmas tree stand. In this embodiment, a liquid tight receptacle having upper portion 32, side surfaces 190 and bottom 192 is supported by a plurality of support legs 194 pivotally mounted in central portions thereof to the upper portion of receptacle 12. Each of support legs 194 has a lower end portion 196 for engaging floor 164 and an upper end portion 198 for engaging the trunk 18 of tree 20. A locking element 200 is secured on one end thereof to the bottom of trunk 18 of the tree, the other end of locking element 200 defining a projection 48 thereon. Bottom 192 of receptacle 12 defines a system of indentations 50 therein for receiving projection 48 on locking element 200.

Upper end portions 198 of support legs 194 engage trunk 18 of tree 20 in such a way that trunk 18 is pivotal with respect to these upper end portions. Accordingly, the bottom of trunk 18 is laterally moveable within receptacle 12 when tree 20 is maintained in a first position in which the bottom of trunk 18 is elevated sufficiently so that projection 48 clears indentations 50 in bottom surface 192 of the receptacle. See FIG. 17B. In this configuration, the bottom of trunk 18 can be moved to any lateral position desired for vertically positioning tree 20. At that time, tree 20 can then be lowered into a second position as illustrated in FIG. 17A with projection 48 then engaging an indentation 50 in receptacle 12. By this means, trunk 18 can be moved into any desired position for vertically positioning tree 20 and then lowered to position illustrated in FIG. 17A for locking trunk 18 in place. The configuration and method of mounting support legs 194 ensures that the weight of the tree and the receptacle locks the tree in place.

Referring to FIGS. 19A, 19B, 19C, 19D and 20, still additional embodiments of the inventive Christmas tree stand are shown, these embodiments being related to the embodiment illustrated in FIG. 2 in that wedges are also used in these embodiments for vertically positioning the tree. In the embodiment illustrated in FIGS. 19A, 19B, 19C and 19D, base 14 is composed of an upper base portion 202 which is moveable with respect to a lower base portion 204. An abutment 206 in upper base portion 202 operatively engages a wedge ring generally indicated at 207 which includes a notched wedge 208 engaging abutment 206, an extension 210 carrying notched wedge 208 and a ring 22 mounted for rotation about the center section 214 of lower portion 204 of base 14. Tab 216 is provided on the outer end of extension 210 for moving extension 210 clockwise or counterclockwise by hand.

In the embodiment shown, the tree stand is provided with three abutments 206 and three associated wedge rings 207. With this structure, each of notched wedges 208 independently moves circumferentially or orbitally with respect to base 14 from a first position in which the thickness of notched wedge 208 is at a minimum to a second position in which the thickness of notched wedge 208 is at a maximum. This, in turn, causes the vertical axis of receptacle 12 to be tipped relatively toward the abutment 206 when the associated notched wedge is in its first position and relatively away from abutment 206 when the associated notched wedge is in its second position. In other words, the angle between abutment 206 and the vertical axis of the receptacle makes with floor 164 at a given abutment 206 is greater when the associated notched wedge 208 in its second position as opposed to its first position. Accordingly, with the structure illustrated in FIGS. 19A, 19B, 19C and 19D, and using three separate wedge rings 212, receptacle 13 can be easily secured into proper position once tree 20 has been moved to its desired vertical position by simple adjustment of the wedge rings. The notches in notched wedges 206 hold the wedges in place, thereby locking receptacle 12 in proper position.

Figure 20:
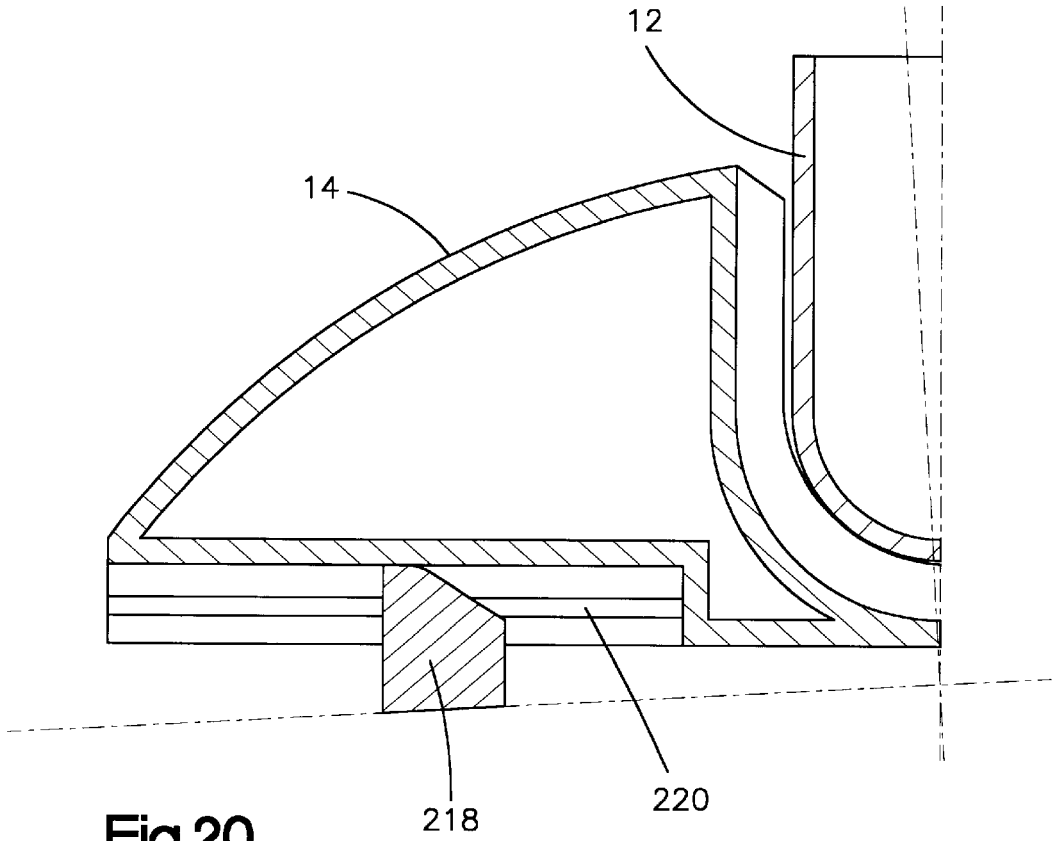
FIG. 20 is a schematic illustrations of a twentieth embodiment of the inventive Christmas tree stand.

The embodiment illustrated in FIG. 20 is similar to that of FIGS. 19A, 19B, 19C and 19D, except that in the embodiment of FIG. 20 wedge members 218 engage floor 164 and base 14 and moreover wedge members 218 move radially in tracks 220 rather than orbitally. Locking means, not shown can be provided to independently lock each of wedge members 218 in place, if desired.

Figure 21A:
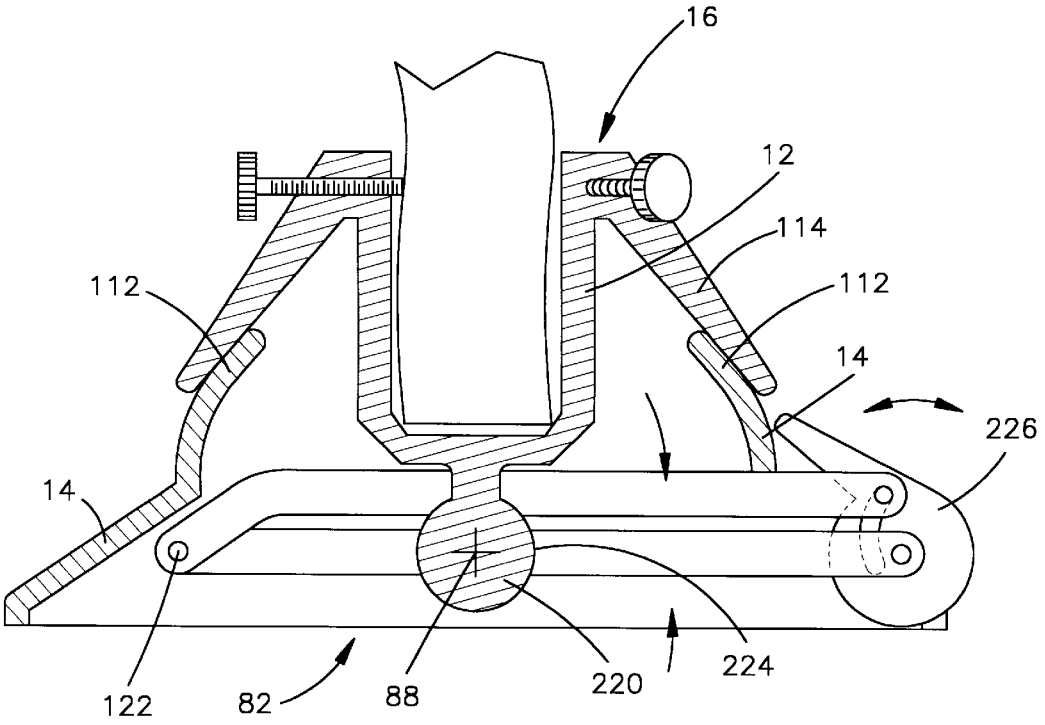
FIGS. 21A and 21B are schematic illustrations of a twenty-first embodiment of the inventive Christmas tree stand.
Figure 21B:
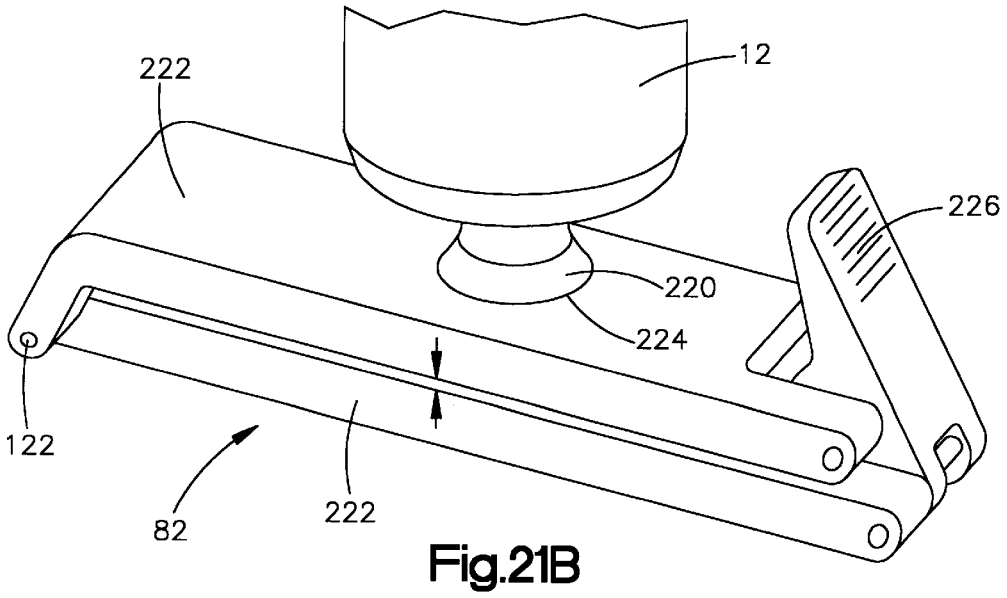

FIGS. 21A and 21B illustrate still another embodiment of the inventive Christmas tree stand. In this embodiment, a spherical skirt 114 integral with receptacle 12 is supported by spherical upper surface 112 of base 14. A ball 220 depending from the bottom of receptacle 12 is adapted to pivot about pivot point 88 which coincides with the center of spherical skirt 114 of receptacle 12 and spherical upper surface 112 of base 14. In order to lock receptacle 12 in place when tree 20 is in a desired vertical position, a locking assembly generally indicated at 82 is provided, this locking assembly comprising two elongated socket-defining members 222. As shown in FIGS. 21A and 21B socket-defining members 222 together define socket 224 for receiving ball 220.

Elongated socket-defining members 222 are pivotally attached together at an axis 122 integral with base 14. On their other ends, socket-defining member 222 are attached to one another by compression lock 226. Compression lock 226 is movable between a disengaged position in which the ends of socket-defining members 222 are loosely held together and a locking position in which the ends of socket-defining members 222 are tightly held together by a significant compressive force.

In use, trunk 18 of tree 20 is placed in receptacle 12 where it is secured in place by clamping means 16. Then, with compression lock 226 in a disengaged position, tree 20 is moved into a desired vertical position. At this time, compression lock 226 is moved to its locking position, whereupon receptacle 12 is locked into position by the extremely great compressive force generated at socket 224 by elongated socket-defining members 222 and compression lock 226.

Christmas tree stands having ball and socket arrangements with compressible sockets for locking the tree in place are already known. To date, none has been successful commercially because the sockets used are generally unable to generate sufficient compressive strength to offset the torque created by an off-center tree. This deficiency is overcome in the embodiment of FIGS. 21A and 21B by defining the socket with elongated socket-defining members 222. With this elongated structure, a lever action is created by the portion of the socket-defining members between the socket and compression lock 226. This lever action allows the amount of comprehensive force created at socket 224 to be increased dramatically, thereby providing sufficient force to offset the torque created by an off-center tree. The additional use of compression lock 226 further contributes to the magnitude of the force generated at the socket. In a preferred example of this embodiment, socket 224 is located relatively close to axis 122, as this increases the compressive force generated at socket 224 even more. Preferably, the distance between socket 224 and compression lock 226 is at least twice as great, more preferably three or more times as great, as the distance between socket 224 and axis 122.

Although only a few embodiments of the present invention have been described above, it should be appreciated that many modifications can be made without departing from the spirit and scope of the invention. All such modifications are intended to be included within the scope of the present invention, which is to be limited only by the following claims:

We claim:

1. A tree stand for supporting and positioning a tree, said stand comprising:

a receptacle for receiving the trunk of said tree, said receptacle having an upper portion and a lower portion, a base releasably receiving said receptacle, said base supporting said receptacle at the upper portion thereof, the lower portion of said receptacle being laterally movable with respect to said base for vertically orienting said tree, a locking assembly for locking the lower portion of said receptacle in place, and an actuator attached to said locking assembly for moving said locking assembly between a locking position and a disengaged position, said receptacle being movable with respect to said base to a desired position for vertically orienting said tree when said locking assembly is in said disengaged position, said receptacle being secured in place with respect to said base when said locking assembly is in said locking position, said locking assembly being biased in said locking position, and said actuator moving said locking assembly against said bias.

2. The tree stand of claim 1, wherein said actuator is a foot pedal.

3. The tree stand of claim 1, wherein said locking assembly defines at least one projection thereon for engaging said receptacle when said locking assembly is in said locking position.

4. The tree stand of claim 1, wherein the upper portion of said receptacle is mounted on said base by means of a universal joint.

5. The tree stand of claim 1, further comprising clamping means attached to the upper portion of said receptacle for securing said tree in said receptacle.

6. The tree stand of claim 1 wherein said receptacle includes a base mating surface and wherein said locking assembly includes a locking pad shaped to receive said base mating surface.

7. The tree stand of claim 6 wherein said base mating surface and said locking pad are spherical.

8. A tree stand for supporting and positioning a tree, said stand comprising:

a receptacle for receiving the trunk of said tree, said receptacle having an upper portion and a lower portion, a base adapted to receive said receptacle in a plurality of different positions, the lower portion of said receptacle being laterally movable with respect to said base for vertically orienting said tree, a locking assembly moveable from a disengaged position to a locking position for locking said receptacle in place with respect to said base, one of said locking assembly and the lower portion of said receptacle defining a set of indentations therein, the other of said locking assembly and the lower portion of said receptacle defining at least one projection for cooperating with said indentations to hold said receptacle in place, and an actuator moving said locking assembly between said locking position and said disengaged position for vertically orienting said tree, wherein said locking assembly is biased in said locking position, and further wherein said actuator moves said locking assembly against said bias.

9. The tree stand of claim 8, wherein said at least one projection is received in a corresponding indentation when said locking assembly is in said locking position, said at least one projection being removed from said corresponding indentation when said locking assembly is in said disengaged position.

10. The tree stand of claim 8, wherein said base has a lower portion defining said at least one projection thereon, said at least one projection being received in at least one indentation in said locking assembly.

11. A tree stand for supporting and positioning a tree, said stand comprising:

a receptacle for receiving the trunk of said tree, said receptacle having an upper portion and a lower portion, a base releasably receiving said receptacle, an upper portion of said base supporting said receptacle, the lower portion of said receptacle being laterally moveable with respect to said base for vertically orienting said tree, a locking assembly for locking the lower portion of said receptacle in place, and an actuator attached to said locking assembly for moving said locking assembly between a locking position and a disengaged position, said receptacle being movable with respect to said base to a desired position for vertically orienting said tree when said locking assembly is in said disengaged position, said receptacle being secured in place with respect to said base when said locking assembly is in said locking position.

* * * * *